US008052002B2

(12) United States Patent
Spindel et al.

(10) Patent No.: US 8,052,002 B2
(45) Date of Patent: Nov. 8, 2011

(54) FOLDABLE BOX THAT COLLAPSES ALONG A BIAS, PROVIDING BOTH TOP AND SIDE ACCESS

(76) Inventors: Martin Spindel, New York, NY (US); Nadine Cino, New York, NY (US)

( * ) Notice: Subject to any disclaimer, the term of this patent is extended or adjusted under 35 U.S.C. 154(b) by 18 days.

(21) Appl. No.: 11/436,307

(22) Filed: May 18, 2006

(65) Prior Publication Data

US 2006/0201942 A1 Sep. 14, 2006

(51) Int. Cl.
*B65D 5/20* (2006.01)
*B65D 6/18* (2006.01)
*B65D 25/28* (2006.01)

(52) U.S. Cl. ..... 220/6; 220/62; 220/651; 229/117.07; 229/121; 229/122; 229/185.1

(58) Field of Classification Search ..... 220/6, 62, 220/651; 229/165, 185.1, 117.04, 117.07, 229/117.01, 121, 122
See application file for complete search history.

(56) References Cited

U.S. PATENT DOCUMENTS 676,393 A * 6/1901 Drawbaugh ..... 229/117.04
728,749 A * 5/1903 McCord ..... 229/117.04
1,091,391 A 3/1914 Romans
2,301,310 A * 11/1942 Messer ..... 206/766
2,531,507 A * 11/1950 Goodyear ..... 229/117.04
3,344,976 A * 10/1967 Mason ..... 229/123.3
3,363,800 A 1/1968 Anderson
3,441,193 A * 4/1969 Castle ..... 229/120.38
3,796,342 A 3/1974 Sanders et al.
4,577,772 A 3/1986 Bigliardi
4,630,746 A 12/1986 Fortenberry
4,646,928 A 3/1987 Ono et al.
4,679,242 A 7/1987 Brockhaus
4,693,387 A 9/1987 Stonier
5,038,953 A 8/1991 Radar
5,064,068 A 11/1991 Sheng
5,107,639 A 4/1992 Morin et al.
5,257,707 A * 11/1993 Soede ..... 220/4.29
5,524,789 A * 6/1996 Jackman ..... 220/666
5,671,858 A 9/1997 Hsu
5,762,261 A * 6/1998 Okabe et al. ..... 229/117.08
6,036,041 A * 3/2000 Chern ..... 220/6
6,223,400 B1 5/2001 Lenack
7,028,834 B2 * 4/2006 Karpel ..... 206/5
7,083,061 B2 8/2006 Spindel et al.
2005/0061811 A1 * 3/2005 Wang ..... 220/6
* cited by examiner

*Primary Examiner* — Anthony Stashick
*Assistant Examiner* — Niki Eloshway
(74) *Attorney, Agent, or Firm* — American Patent Agency; Daniar Hussain; Albert Ho

(57) ABSTRACT

A collapsible box that provides access through both its top and front side, said box comprising sets of interior and exterior sidewalls, said interior sidewalls folding inward along a hinge and said exterior sidewalls folding along a hinge that runs along a bias. Said box capable of being made from either flat sheet material or molded parts.

16 Claims, 31 Drawing Sheets

FOLDABLE BOX THAT COLLAPSES ALONG A BIAS, PROVIDING BOTH TOP AND SIDE ACCESS

BACKGROUND OF THE INVENTION

Boxes are commonly used in transporting, moving, conveying, sorting and storing goods and materials, and are employed by a diversity of industries such as trucking, warehousing, manufacturing, office moving and household goods moving.

In its preferred embodiment, the box of the present invention is made of either corrugated cardboard ("corrugated") or paperboard. But it could also be made of other materials including, without limitation, plastic, metal or wood.

In a preferred embodiment, the box of the present invention is both foldable and collapsible. As a foldable box, it is initially die cut, as a pattern, from flat sheet stock, such as corrugated. Thereafter, such die-cut flat sheet is folded along various fold-lines and glued or stapled until it has been "formed". Once formed, the box can typically be maintained in either "open" or "closed" position without need to either return it to flat sheet stock or re-form it. When a formed box is in open position, it can be quickly and easily collapsed into closed position, thereby conserving space. In reverse, when a formed box is in closed position, it can be quickly and easily opened, thereby making it available to hold contents.

In one scenario, the box of the present invention can be shipped from a factory as flat sheet stock, thereby minimizing both production and shipping costs. The box would be later formed by the final user. In another scenario, the box could be formed at the factory level and then shipped in closed position, thereby reducing shipping costs as compared to boxes that require shipping in open position.

In an alternative embodiment, the box of the present invention could be made from parts that are not cut from flat sheet. As an example, without limitation, such parts could be molded of plastic using a process such as injection molding. Where applicable, such parts could be hinged together using any of a variety of hinging methods.

A major benefit of the preferred embodiment of the box of the present invention is that, when in open position, both the top lid and front door of said box can be opened at the same time. Thereby, objects can be loaded into said box (or unloaded from it) without either lifting them over a front wall or sliding them under a top wall. Such configuration in which both the top lid and front door are simultaneously open is possible when said box is either standing alone or positioned at the top of a stack of other boxes.

In its preferred embodiment, when the box of the present invention has other boxes stacked above it, the front wall of said box can still be opened. Thus, another major benefit of said preferred embodiment is that frontal access to any box in a stack is possible. Thereby, objects can be loaded into, or unloaded from, a lower box within a stack without lifting the box or boxes above it.

Since both the top wall and front wall of the preferred embodiment of the box of the present invention can be opened, said walls are referred to herein as a "top lid" and "front door," respectively U.S. Pat. No. 3,796,342 to Sanders et. al. and U.S. Pat. No. 4,693,387 to Stonier disclose collapsible containers. However, the Sanders and Stonier containers only allow top access. Neither container allows front access or can be formed from flat sheet stock, as does the box of the present invention. Nor do the Sanders and Stonier containers disclose: (i) a combination of both front and top access, (ii) any form of a front lid or front door or (iii) a combination of a front door and top lid, as does the present invention. The benefits of the present invention over Sanders and Stonier are significant in that the present invention minimizes production and shipping costs and allows (i) frontal access to any box in a stack without removing the boxes above it and (ii) easy loading and unloading with lifting objects over a sidewall or sliding objects under a top lid. Furthermore, in a preferred embodiment the structure of the present invention comprises a pair of vertical inner sidewalls (items 203J and 203K in FIG. 5C) that provide additional strength for bearing a load; the Sanders and Stonier containers lack such inner sidewalls.

SUMMARY OF THE INVENTION

In a preferred embodiment, the box of the present invention, when in open position, is rectangular in shape and essentially comprises a top lid, floor, back wall, a pair of opposed vertical sidewalls and a hinged front door. Each of said vertical sidewalls is comprised of an exterior sidewall and an interior sidewall. Said exterior sidewall folds upon a hinge to collapse, said hinge running along a bias. In the preferred embodiment of the box of the present invention, said bias runs along a diagonal line that extends upwardly and outwardly from the point at which the bottom of said sidewall meets the back wall of said box to a point at the top of said sidewall near the front of said box. In alternative embodiments, said bias could be otherwise configured. For example, without limitation, said bias could run along a diagonal line that extends upwardly and inwardly from the point at which the bottom of said sidewall meets the front of said box to a point at the top of said sidewall near the back of said box.

When the box of the present invention is in open position, the aforementioned floor of said box is comprised of three sheets of corrugated cardboard. The outermost, innermost and middle sheets of said three sheets are referred to herein as the "exterior floor panel," "interior floor panel" and "middle floor panel, respectively.

A hinged panel extends outwardly from said interior floor panel, said hinged panel comprising a pair of opposed rounded wings extending from its left and right sides. Said hinged panel and wings comprise the "front door" of said box. Said front door can swing between open and closed positions. Said front door is closed by swinging it upward and tucking said wings between the aforementioned exterior and interior sidewalls. Said front is opened by swinging it downward, thereby allowing frontal access to the interior of said box.

In a preferred embodiment, a closure arrangement on each of the left and right sides of the box secures both the top lid and front door to the exterior sidewall. The closure on either side that secures the top lid to the exterior sidewall comprises a "button and loop" structure; said loop comprising a flexible band that is permanently affixed to said top lid and can be wrapped around said button; said button comprising a rigid "head" attached to said box. The closure that secures the front door to the exterior sidewall comprises a "button and tab" structure; said tab comprising a small piece of stretchable material that is permanently affixed to said front door; said flexible material comprising a slit that can be wrapped around the same button as does the aforementioned loop.

When the box of the present invention is in closed position, said box comprises a horizontal upper section and horizontal lower section. In a preferred embodiment, said upper section is comprised of a set of panels that extend from the exterior back wall of said box. When said box, starting from closed position, is in the process of being opened, each panel of the set that comprises said upper section swings into position to comprise a different component of said box. One of said panels swings into position to comprise the interior back wall of said box. The other panels swings into position to comprise the top lid of said box, said top lid comprised of two thicknesses of corrugated sheet glued together. Both of said panels swing by rotating about a hinge that runs along the horizontal upper edge of the exterior back wall of said box.

BRIEF DESCRIPTION OF THE DRAWINGS

FIGS. 3 through 9A are perspective frontal views showing the successive steps in which an open box is formed from flat sheet stock. FIG. 8 shows the box of the present invention with both its top lid and front door in open position, thereby providing both top and front access to the interior of said box. FIG. 9A shows a fully formed box in open position with its top lid open and front door closed, said front door and the exterior sidewalls of said box secured to each other by the aforementioned button and tab structure. While in the configuration shown in FIG. 9A, top access is provided to the interior of said box through the opening at its top. Front access is not provided while in said configuration.

DETAILED DESCRIPTION OF THE INVENTION

Figure 1:
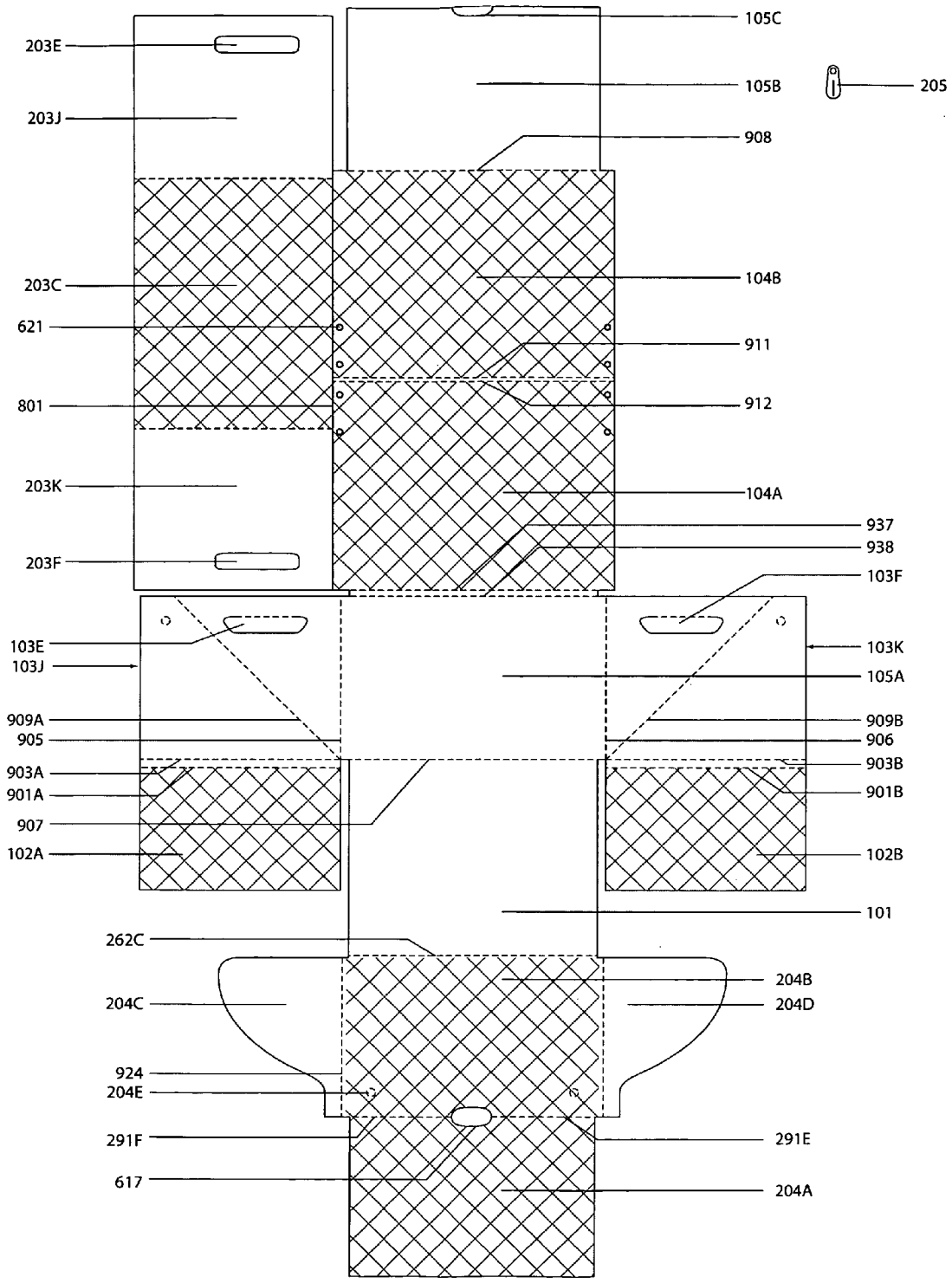
FIG. 1 shows the flat, die cut main sheet of corrugated from which the box of the present invention is primarily formed. Lines along which panels are die cut and detached from such main sheet are shown as solid lines and are referred to herein as "cut lines". Lines along which panels are folded or turned are shown as dotted lines and are referred to herein as "crease lines." Such "crease lines" are created by pressing an indentation into the corrugated sheet. As an alternative to creasing, corrugated sheet could be "scored," which is done by either cutting a line across the sheet in intermittent sections or cutting part way through its thickness. Areas in which glue is applied to the corrugated sheet are indicated by diagonal cross-hatch lines.
Figure 2:
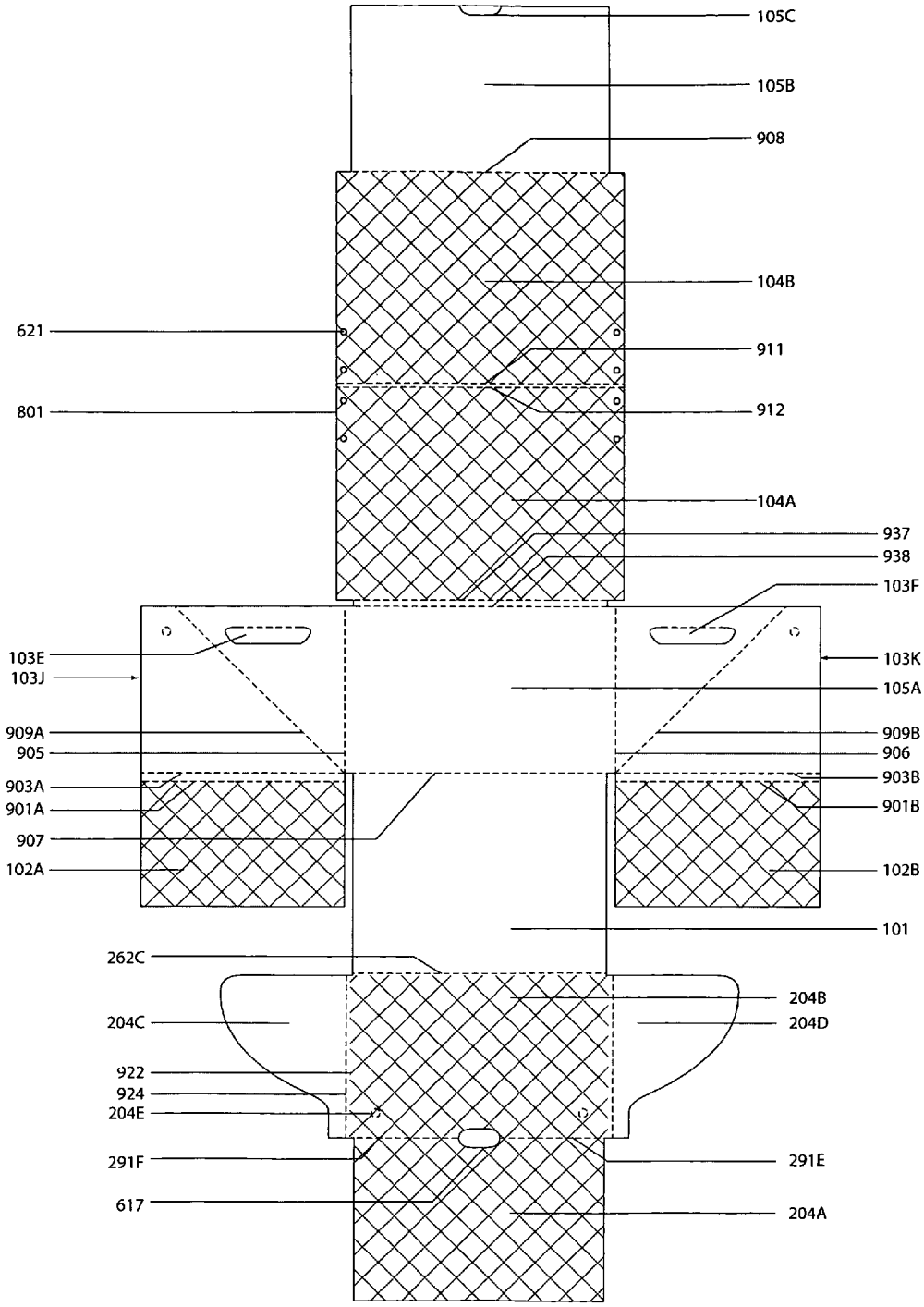
FIG. 2 shows the flat die cut sheet of FIG. 1 after certain panels have been detached from said sheet.

FIG. 1, in part, comprises the flat panels from which opposed interior sidewalls 203J and 203K, and middle floor panel 203C, are formed. FIG. 2 comprises the flat die cut sheet of FIG. 1 after said panels 203J, 203K and 203C have been detached along cut line 801 (FIG. 1).

Figure 3:
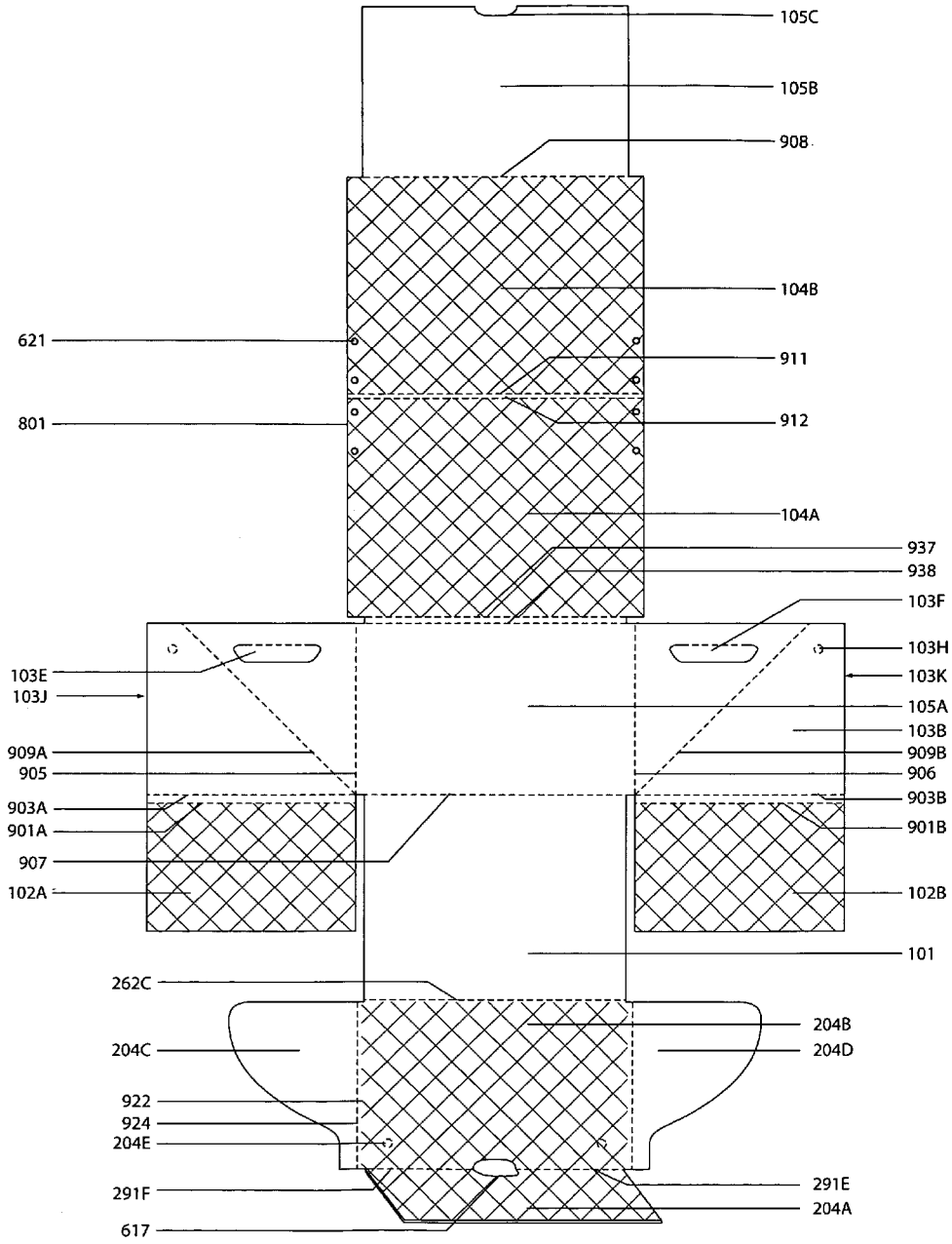
Figure 4:
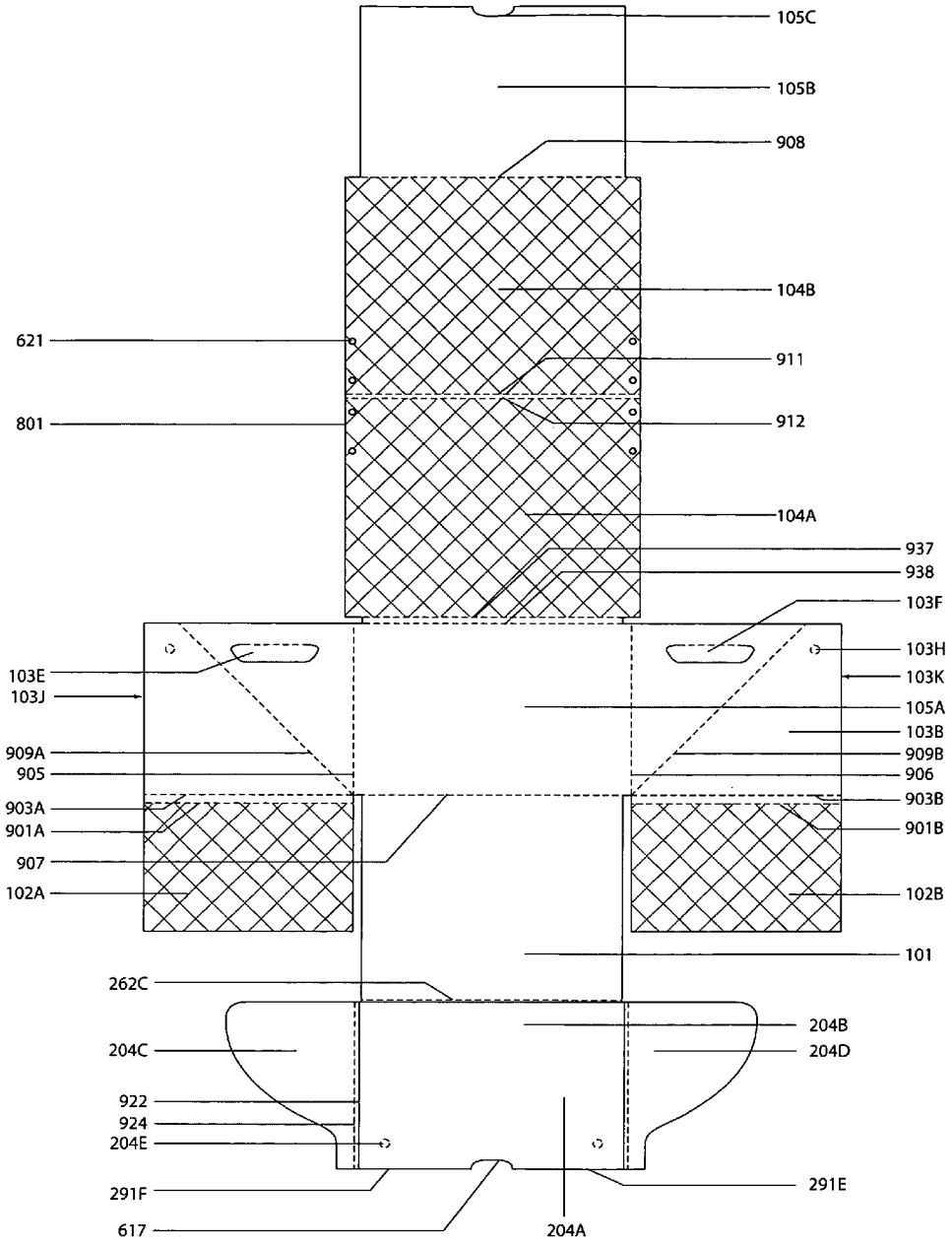

FIG. 2 shows the flat panels of corrugated sheet 204A and 204B that can be folded along crease lines 291F and 291E to form the aforementioned front door, said panels referred to herein as the "inside panel" and "outside panel", respectively. Outside panel 204B extends outwardly from exterior floor panel 101. Inside panel 204A extends from outside panel 204B. FIG. 3 shows inside panel 204A after it has been turned upward about 90 degrees. FIG. 4 shows inside panel 204A after it has been turned upward a full 180 degrees, thereby overlapping outside panel 204B and glued to it to form the center section of the front door of said box. Opposed rounded wings 204C and 204D extend from the left and right sides of outside panel 204B. Said center section and opposed rounded wings comprise the "front door" of said box. Crease line 262C acts as a hinge between said front door and said exterior floor panel of said box. Said front door rotates between open and closed positions upon said hinge 262C. In alternative embodiments, said front door could extend from (and be hingedly attached to) to other locations including, without limitation, the top lid or the interior or exterior sidewalls of said box. Hole 617 provides a finger notch to facilitate opening said front door.

Figure 5A:
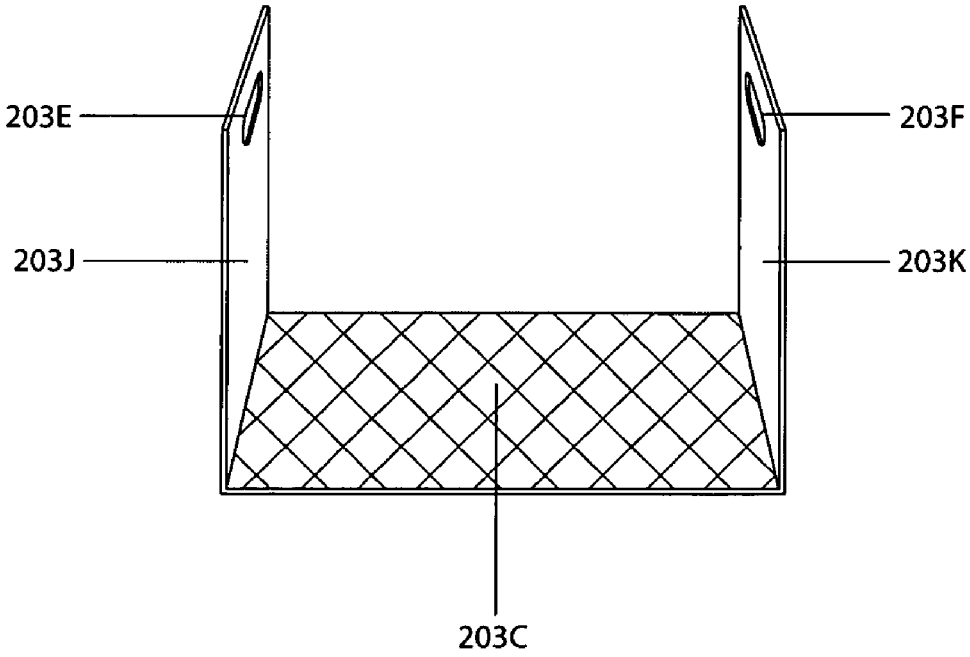
Figure 5B:
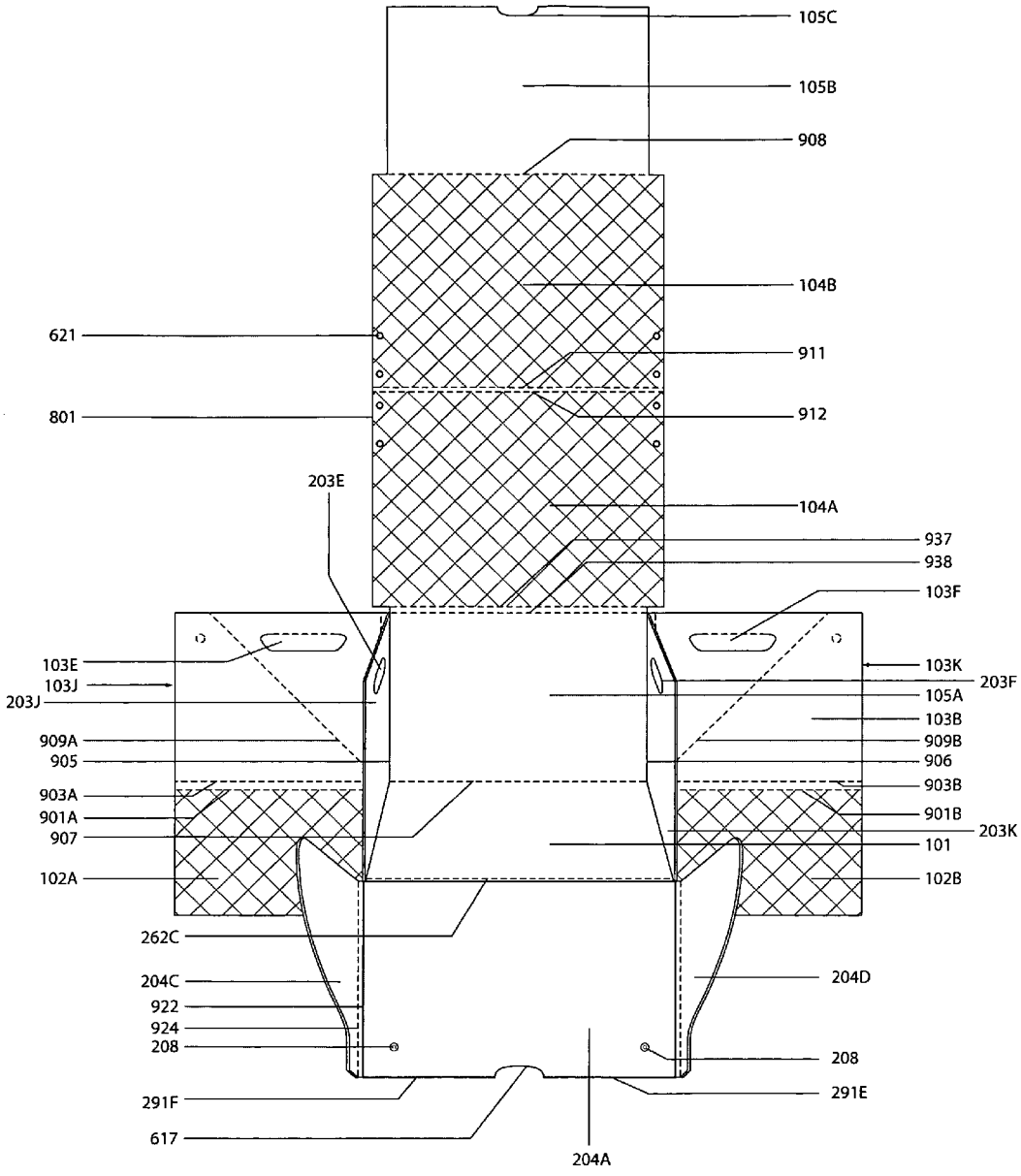

FIG. 5A shows panels 203J and 203K after they have been turned ninety degrees upward with respect to middle floor panel 203C. FIG. 5B shows a preferred embodiment in which panels 203J and 203K are positioned to form the interior sidewalls of the box. The upper side of middle floor panel 203C has been glued to the lower side of interior floor panel 101. In alternative embodiments, said opposed interior sidewalls and middle floor panel could extend from locations other than those shown in the preferred embodiment. Said interior sidewalls 203J and 203K comprise holes 203E and 203F, respectively.

Figure 5C:
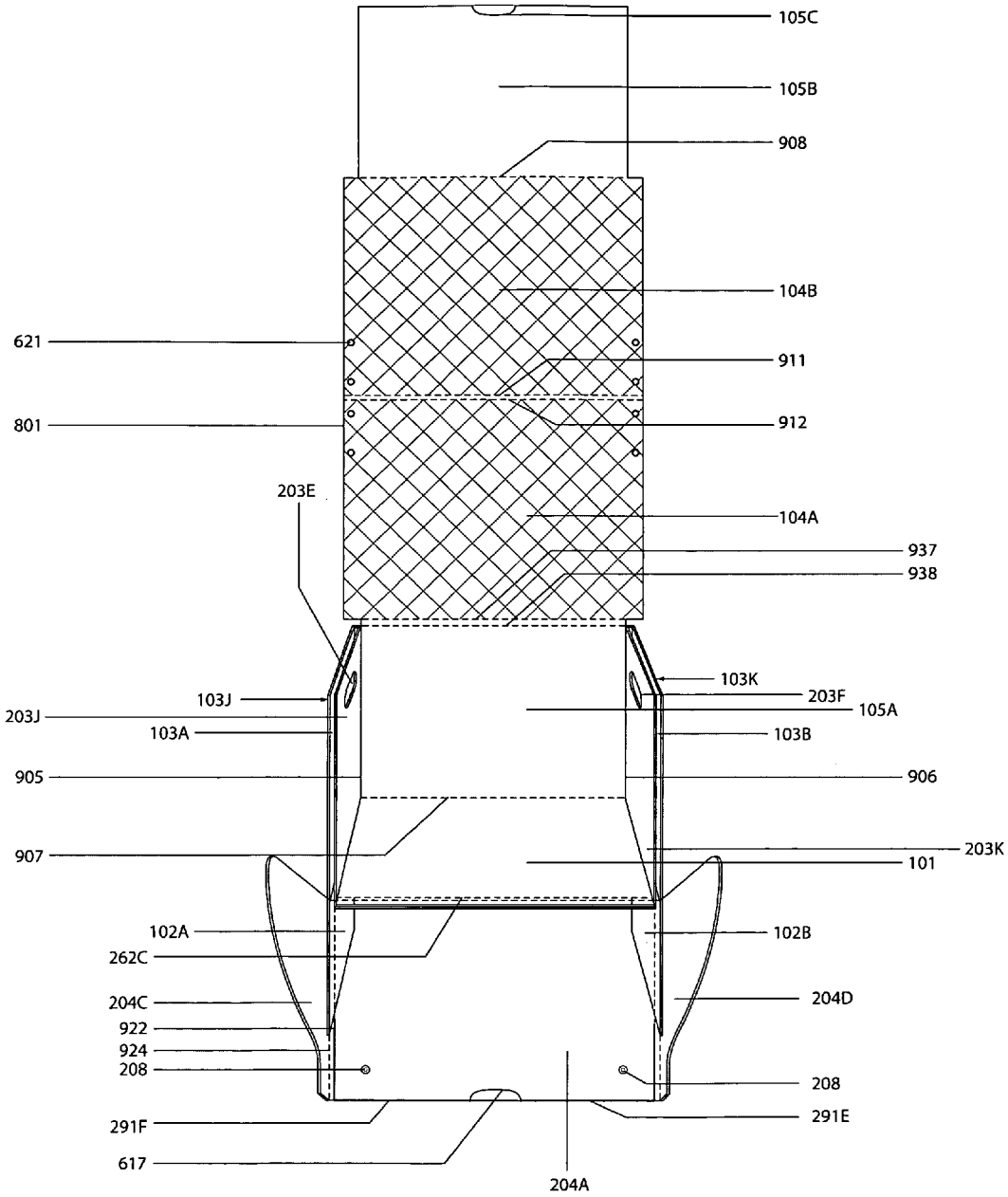

FIG. 5B shows opposed panels 103J and 103K and opposed panels 102A and 102B as flat sheet before being turned. FIG. 5C shows said panels 103J, 103K, 102A and 102B after having been turned ninety degrees inward along crease lines 905 and 906 (FIG. 1). Panels 103J and 103K form the opposed exterior sidewalls of the box. Said exterior sidewalls comprise holes 103E and 103F, respectively. Holes 103E and 103F are aligned with the aforementioned holes 203E and 203F, respectively, thereby forming a set of gripping areas through which hands can be inserted for carrying the box. FIG. 5C further shows panel 105A after it has be turned along crease line 907 to form the exterior back wall of the box of the present invention. In FIGS. 5B and 5C, wings 204C and 204*d* have been partially turned inward along crease lines 924.

Figure 5D:
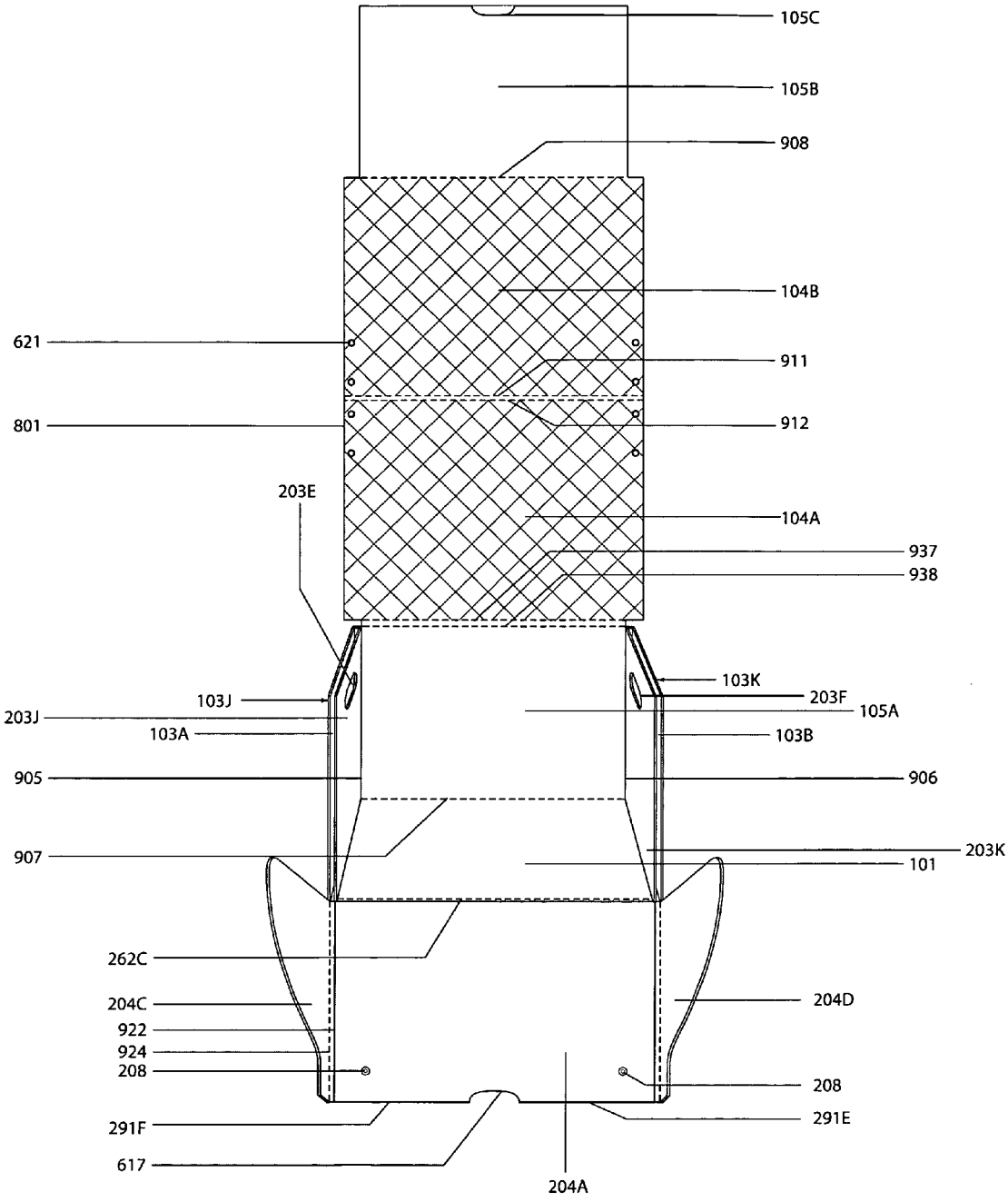

FIG. 5D shows the box of the present invention after the aforementioned panels 102A and 102B (not visible in FIG. 5D) have been turned ninety degrees upward and glued to the underside of middle floor panel 203C, said panels 102A and 102B thereby comprising the exterior floor panels of said box. Panel 102A has been turned along crease lines 901A and 903A; panel 102B has been turned along crease lines 901B and 903B. With respect to each of said panels, a double set of crease lines is used to facilitate turning.

In FIG. 5D, exterior floor panels 102A and 102B, interior floor panel 101 and middle floor panel 203C overlap each other and are glued together to form the triple thickness floor of box of the present invention. Alternative embodiments may comprise single, double or other floor thicknesses.

Figure 6:
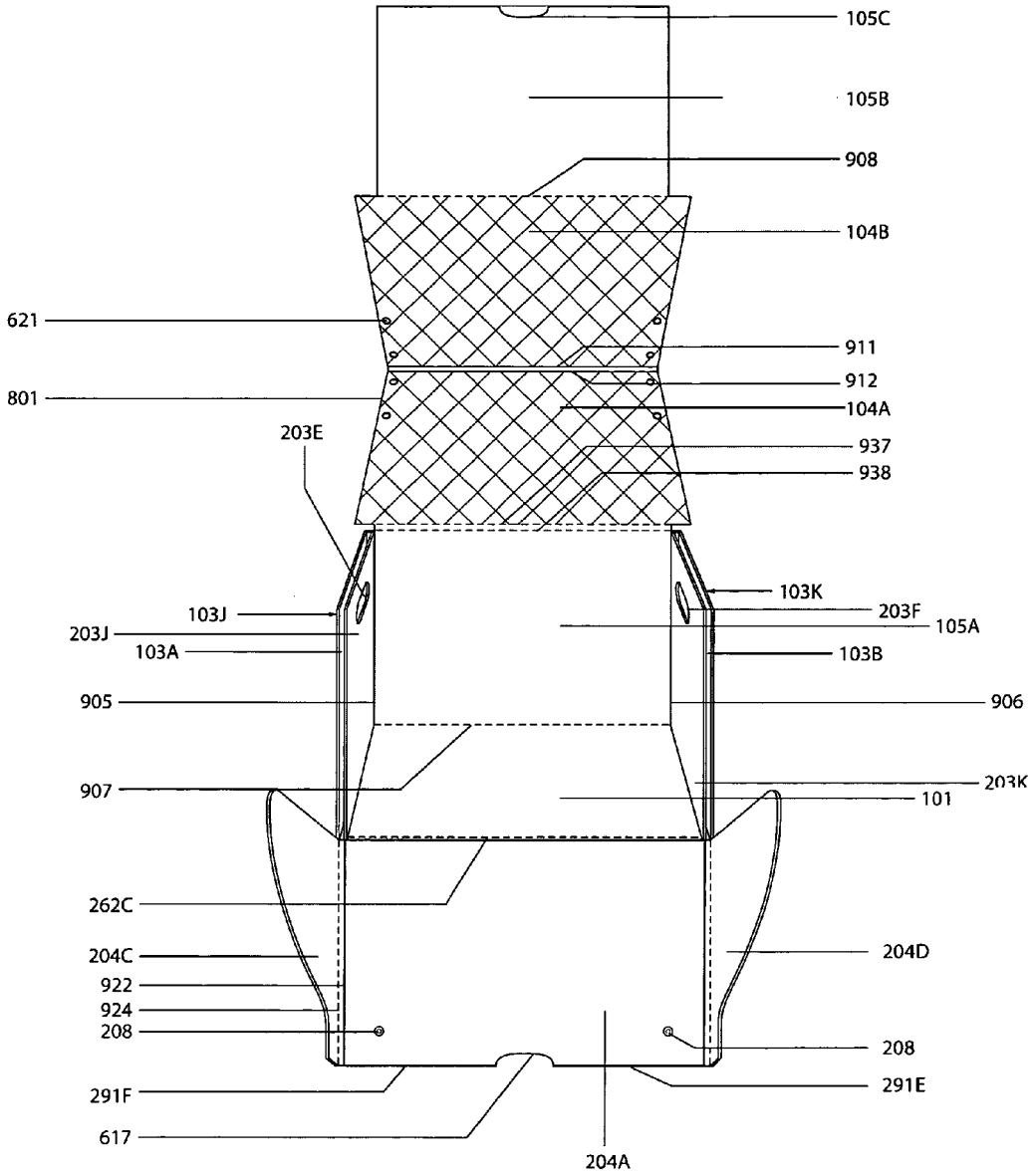

FIG. 6 shows: (i) panels 104A and 104B in the process of being folded towards each other along crease lines 911 and 912 and (ii) panel 105B after it has been turned with respect to panel 104B along crease line 908.

Figure 7:
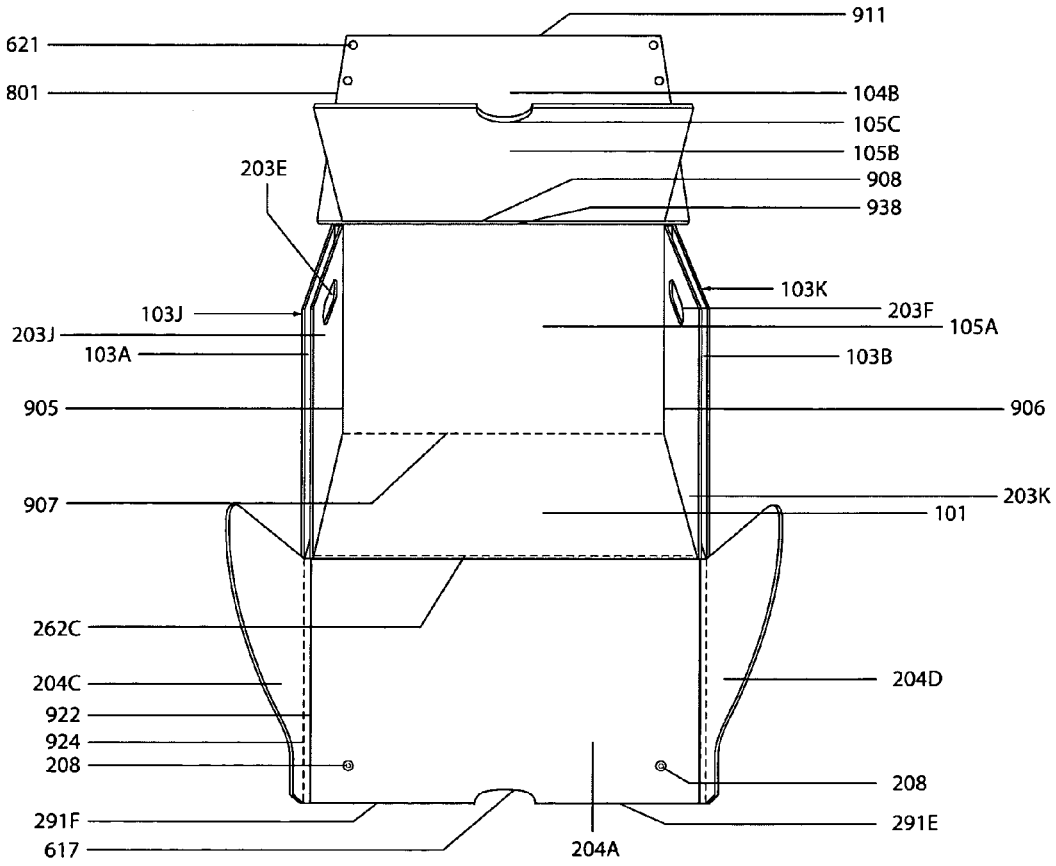

FIG. 7 shows: (i) panel 104B after it has been fully folded and glued to panel 104A, thereby forming a double-thickness top lid of the box of the present invention. FIG. 7 further shows panel 105B after it has been turned with respect to panel 104B along crease line 908. Alternative embodiments may comprise single, triple or other top lid thicknesses.

Figure 8:
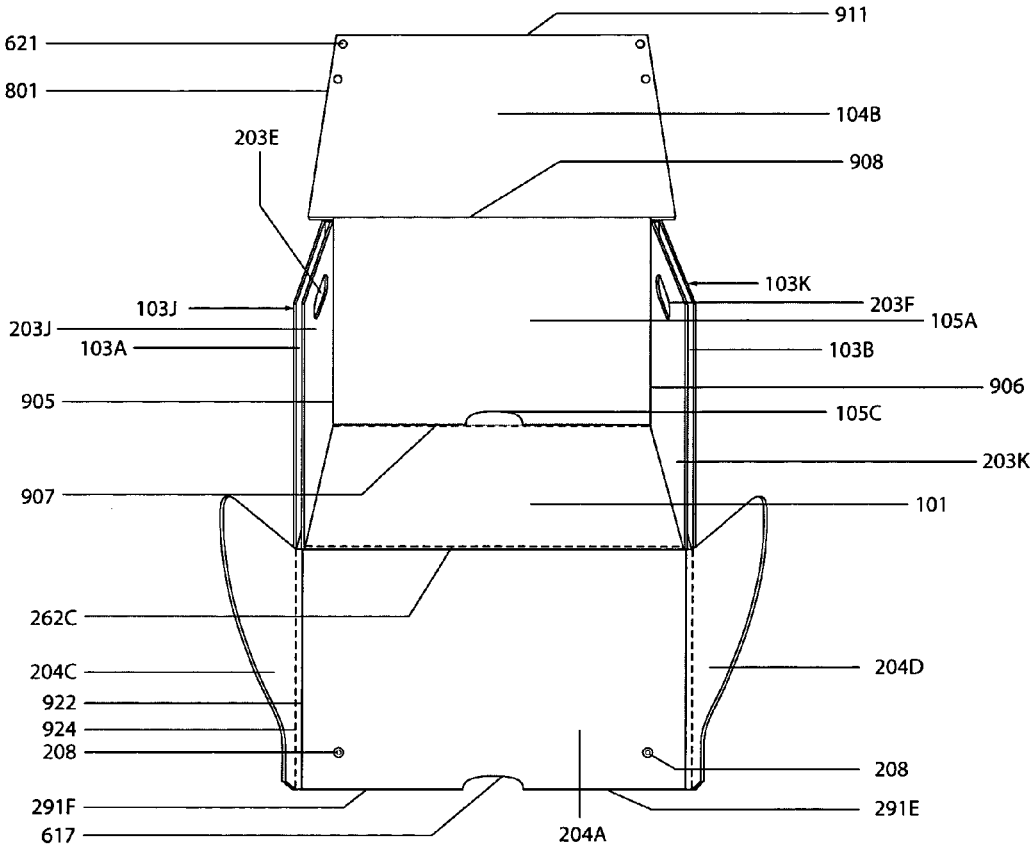

FIG. 8 shows panel 105B after it has been turned downward along crease line 908 to form the interior back wall of the box of the present invention.

Figure 9A:
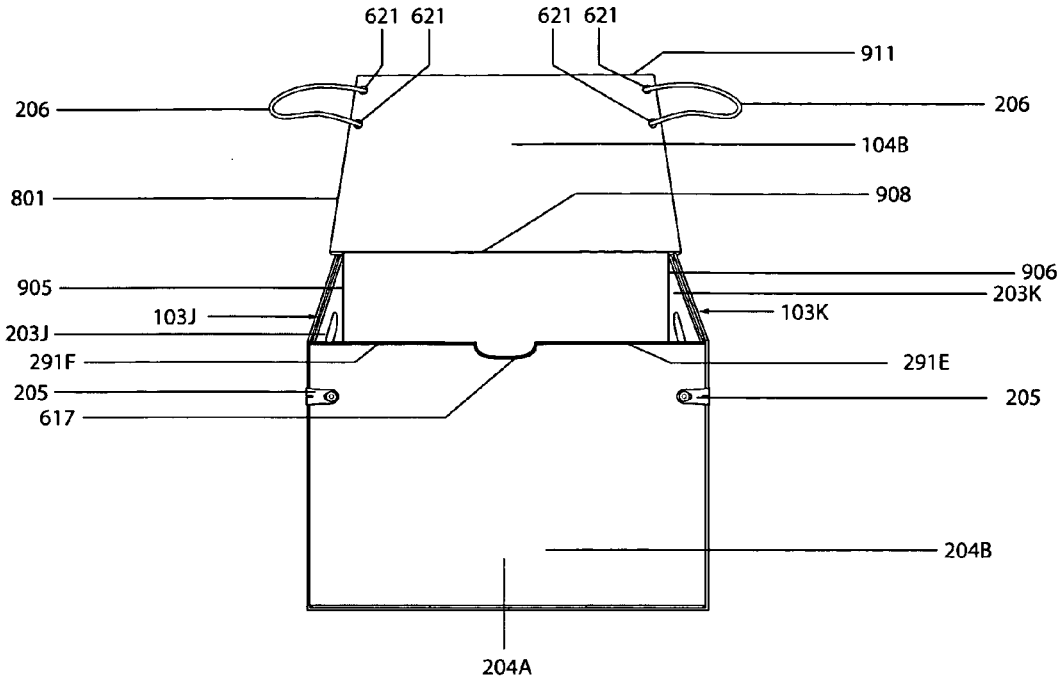

FIG. 9A shows the box of FIG. 8 after the front door has been swung into closed position. The aforementioned center section of said front door covers the front opening of the box. Left wing 204C (FIG. 1) is tucked between exterior sidewall 103J (FIG. 1) and interior sidewall 203J (FIG. 1); right wing 204D (FIG. 1) is tucked between exterior sidewall 103K (FIG. 1) and interior sidewall 203K (FIG. 1). Stretchable tab 205 (FIG. 9A) is wrapped around button 208 (FIG. 9B), thereby securing said front door to said exterior sidewall. In a preferred embodiment, said tab 205 is permanently riveted, or otherwise affixed, to said front door.

Figure 9B:
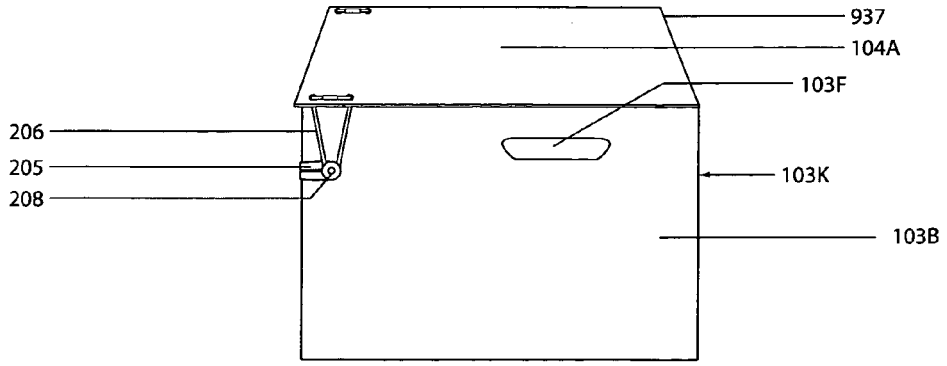
FIG. 9B is a perspective side view of a fully formed box of the present invention in open position with both its top lid and front door closed, both said top lid and front door secured to said exterior sidewalls by the aforementioned button and loop structure and button and tab structure, respectively.
Figure 9C:
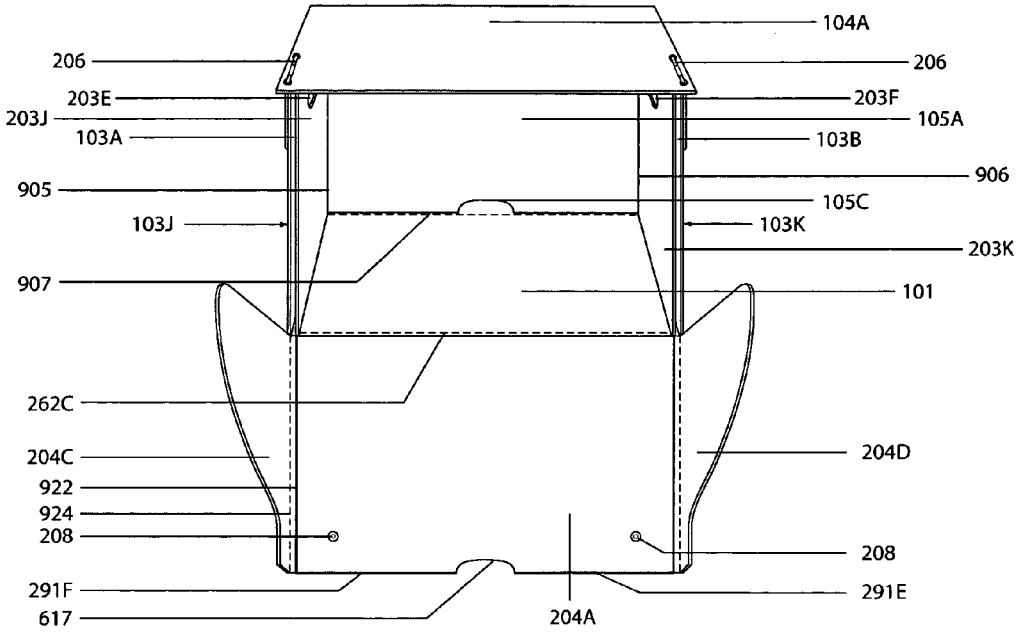
FIG. 9C shows a fully formed box in open position with its top lid closed and front door open, said top lid and exterior sidewalls secured to each other by the aforementioned button and loop structure. While in the configuration shown in FIG. 9C, front access is provided to the interior of said box through the opening at its front. Top access is not provided while in said configuration.
Figure 9D:
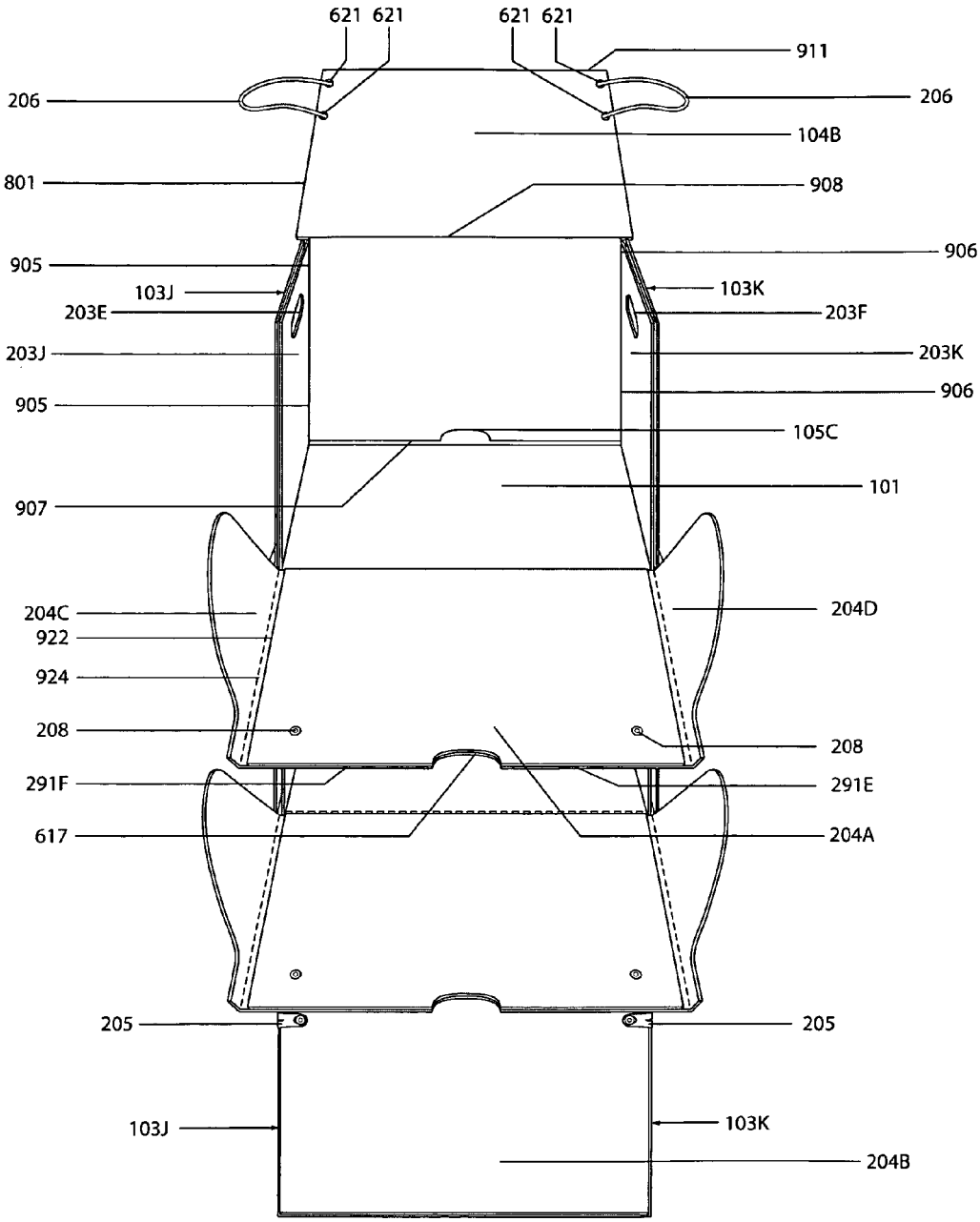
FIG. 9D shows a stack of three fully formed boxes. The top box is shown with both its top lid and front door open; the middle box is shown with only its front door open; and the bottom box is shown with both its top lid and front door closed
Figure 10:
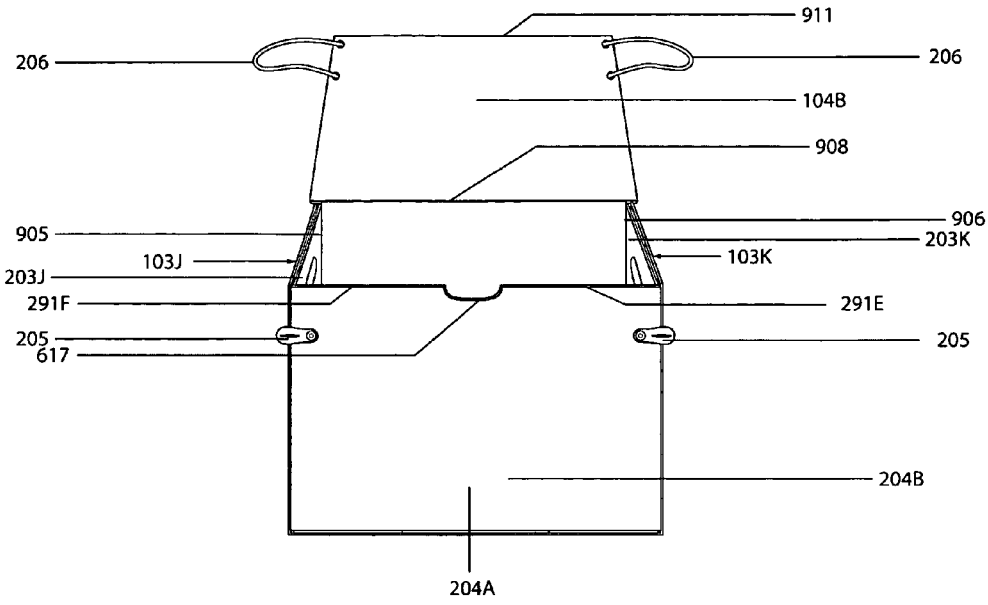
FIG. 10 is a perspective frontal view of said box in open position with its top lid open and front door closed. Although said front door is closed, said front door and exterior sidewalls are not secured to each other by the aforementioned button and tab structure.

FIG. 9B shows the top lid of said box after said top lid has been turned downward along crease line 937 and 938 (FIG. 6) into closed position. Loop 206 and tab 205 are both wrapped around button 208. Tab 205 secures said front door to said exterior sidewall. Loop 206 secures said top lid to said exterior sidewall. In a preferred embodiment, said loop 206 is permanently affixed to said box by passing it through pair of holes 621 in said top lid. In a preferred embodiment, said button 208 is permanently riveted, or otherwise affixed, to said exterior sidewalls. In a preferred embodiment, loop 206 is similar in shape to a common rubber band and tab 205 has an oblong shape, although other shapes and structures of said loop and tab are possible in alternative embodiments.

Figure 11:
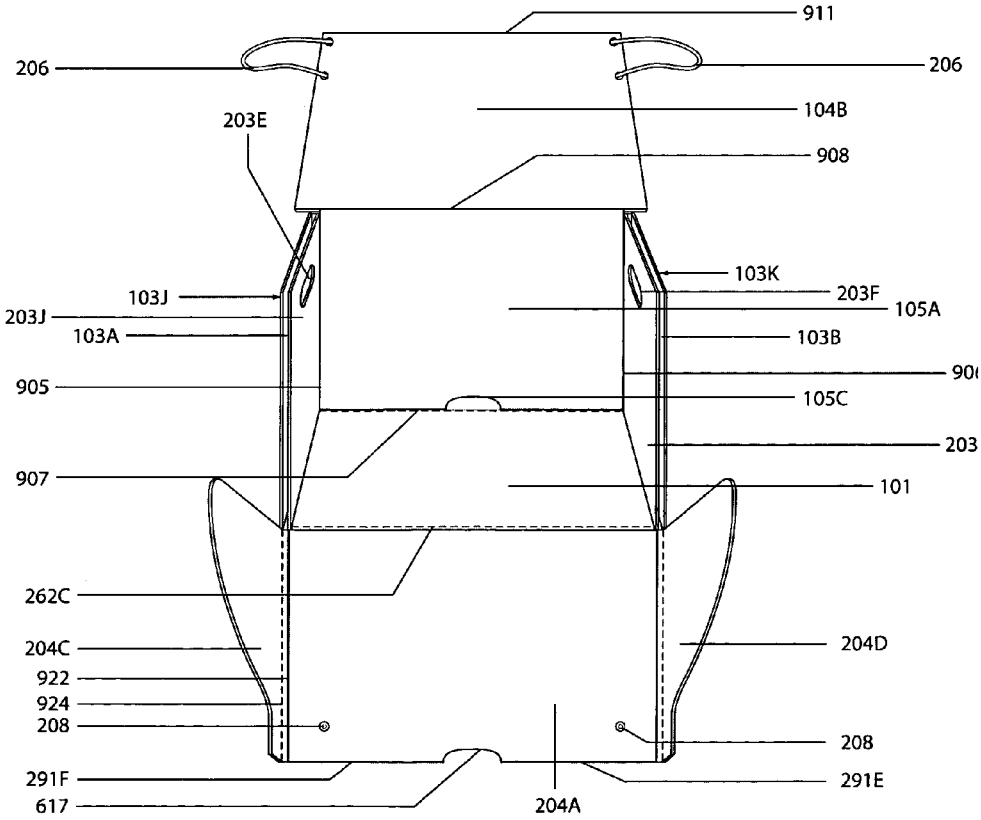
FIGS. 11 thru 15B, and FIG. 15D, are perspective frontal views showing the successive steps in which the box of the present invention is collapsed into closed position.
Figure 12:
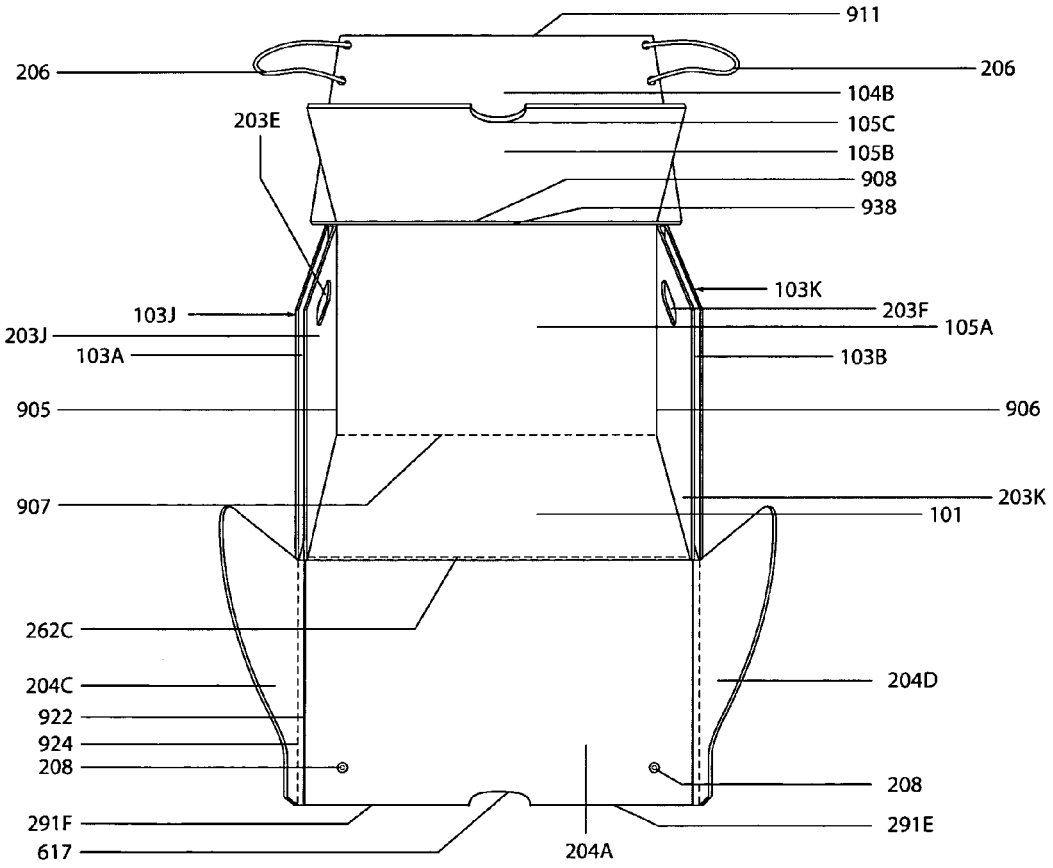

FIG. 11 shows the results of a first set of steps in the process of collapsing the box of the present invention. In FIG. 11, the top lid of said box has been opened, exposing panel 104B as the underside of said top lid. Also in FIG. 11, the front door of said box has been opened, exposing panel 204A as the back side of said front door. In FIG. 12, interior back wall 105B has been turned upward about 130 degrees.

Figure 13:
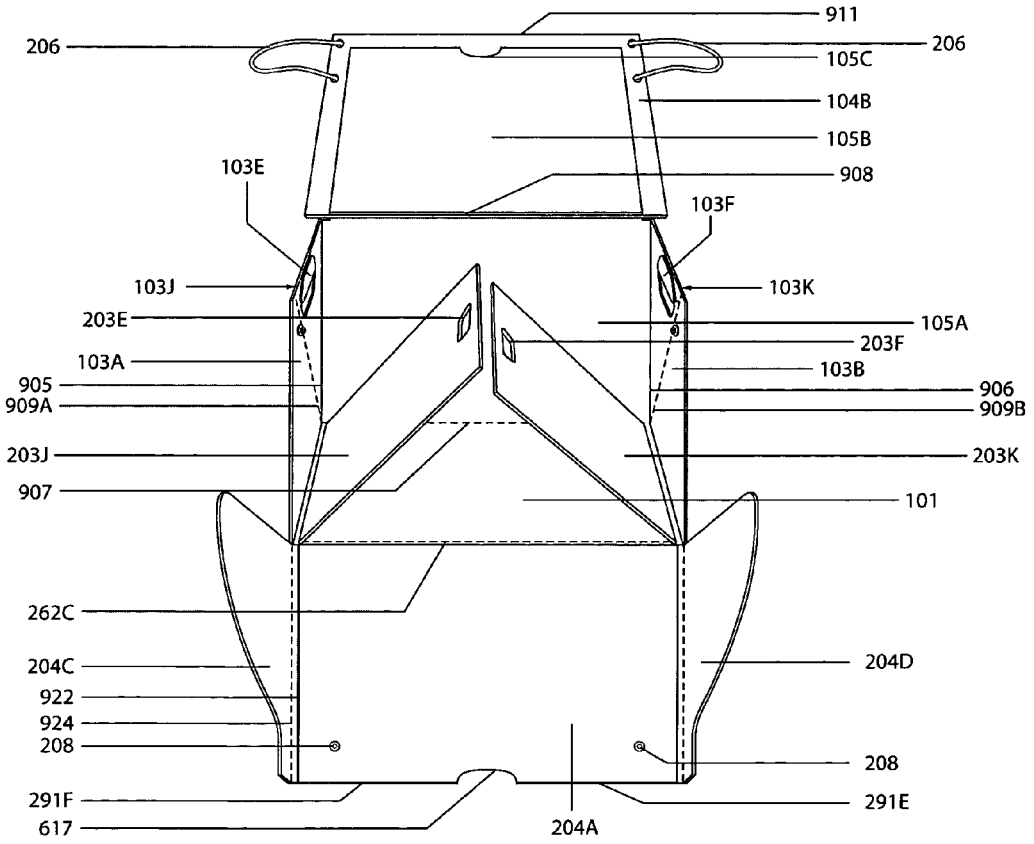
Figure 14:
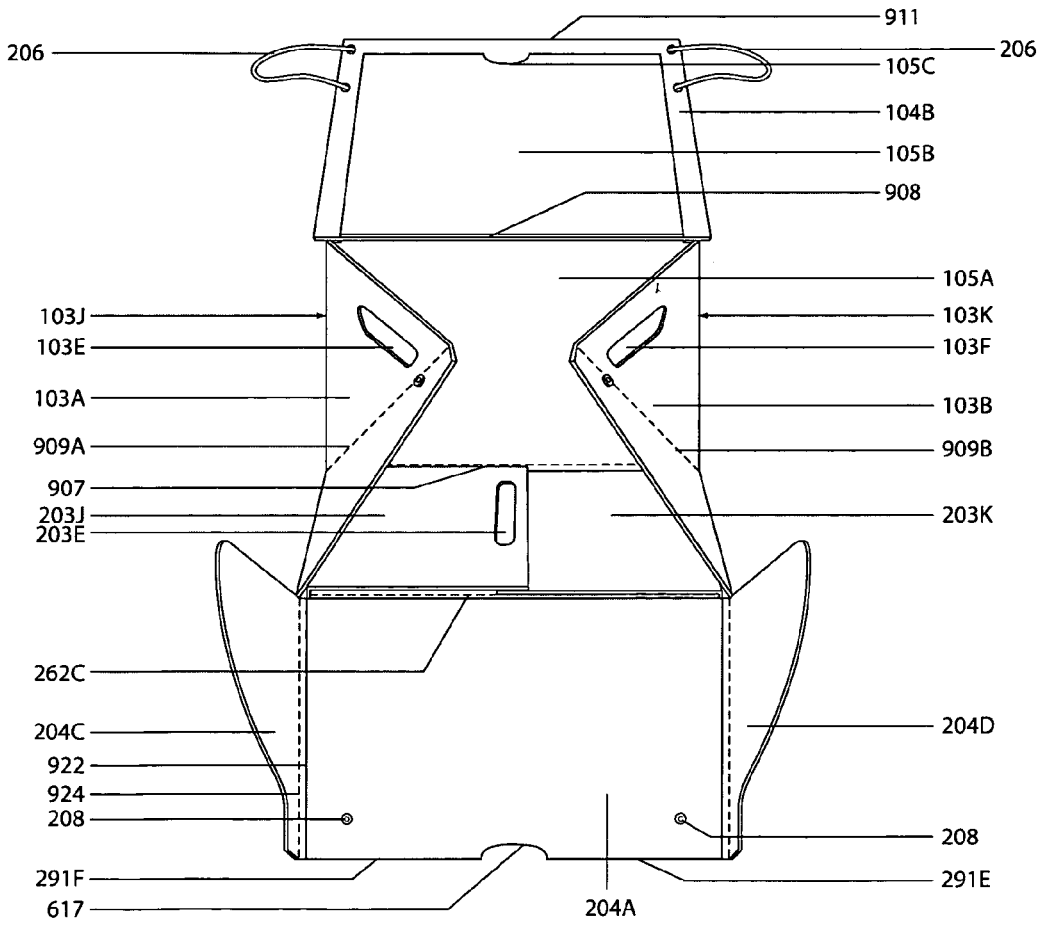
Figure 15A:
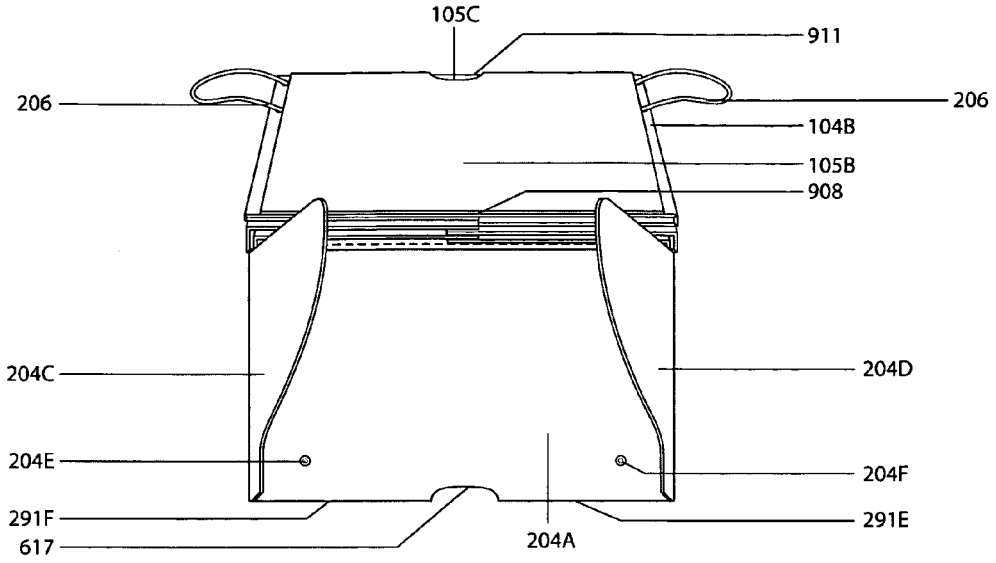
FIG. 15C is a perspective side view showing the top lid in the process of being folded under the floor of said box.
Figure 15B:
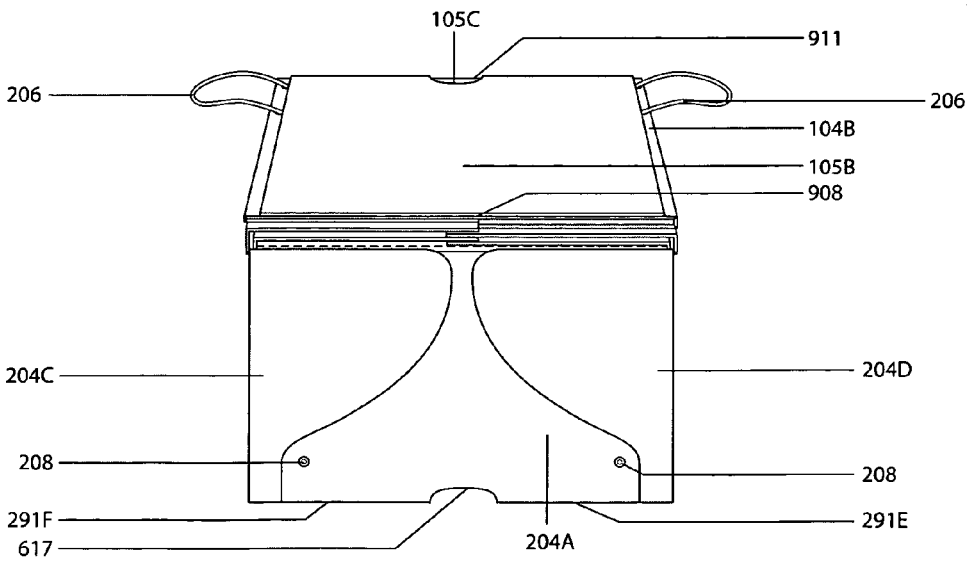
Figure 15C:
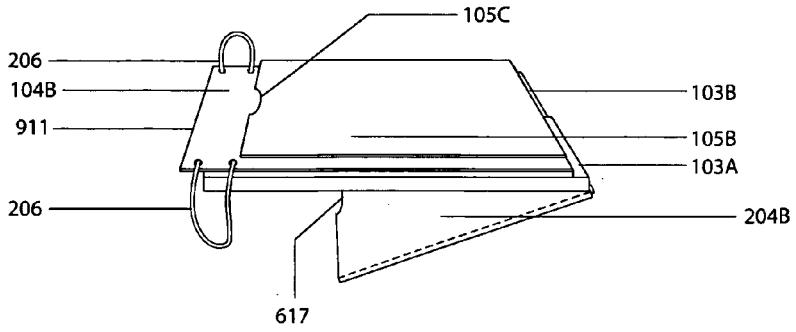
Figure 15D:
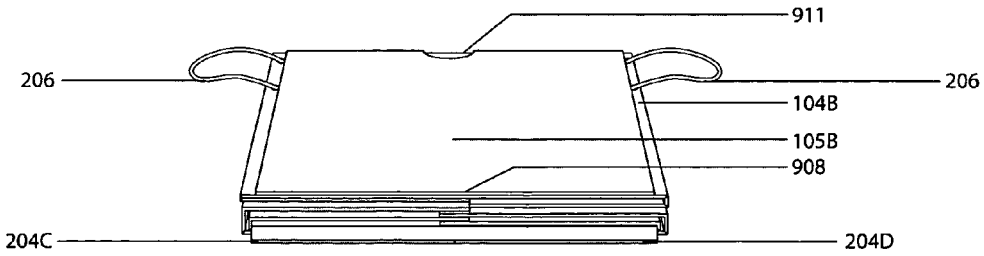

In FIG. 13, interior sidewalls 203J and 203K are in the process of being folded downward. In FIG. 14: (i) said interior sidewalls 203J and 203K have been folded fully downward and rest atop exterior floor panel 101 (as shown in FIG. 12) and (ii) exterior sidewalls 103J and 103K are in the process of being collapsed inward along crease lines 909A and 909B, respectively. FIG. 15A shows the box of the present invention with exterior sidewalls 103J and 103K fully collapsed. FIG. 15B shows wings 204C and 204D fully folded inward and resting atop inside panel 204A of said front door. FIG. 15C is a side view showing said front door in the process of being turned underneath the floor of said box upon crease line, or hinge, 262C. FIG. 15D is a front view showing the box of the present invention fully collapsed with said front door fully turned, and resting beneath, said floor.

In the above described preferred embodiment of the box of the present invention, the interior sidewalls (203J and 203K) extend from the floor of said box. In a first alternative embodiment, the comparable interior sidewalls (6203J and 6203K) extend from the back wall of said box.

Figure 16A:
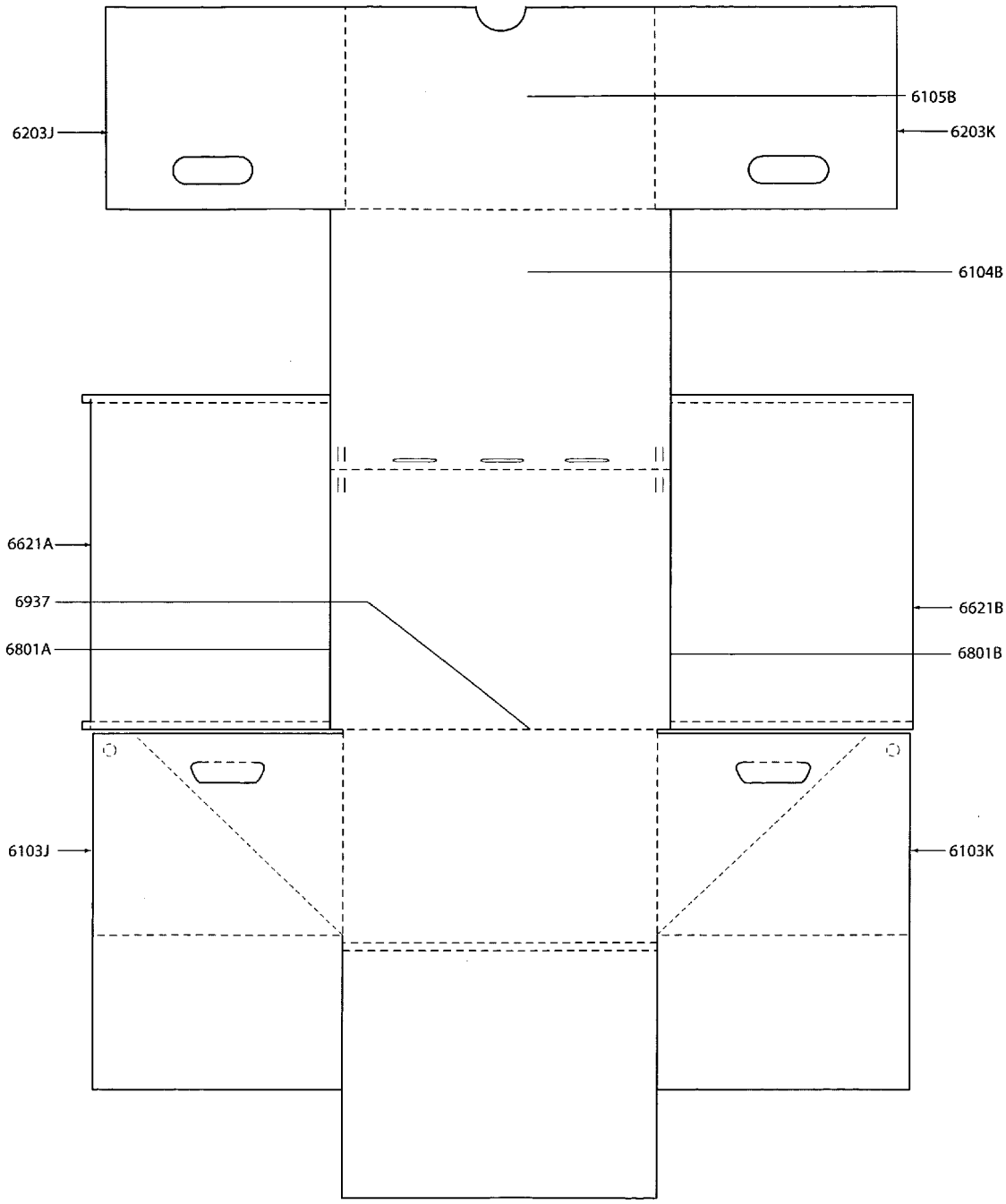
FIGS. 16A thru 18I show an alternative embodiment of the box of the present invention.
Figure 16B:
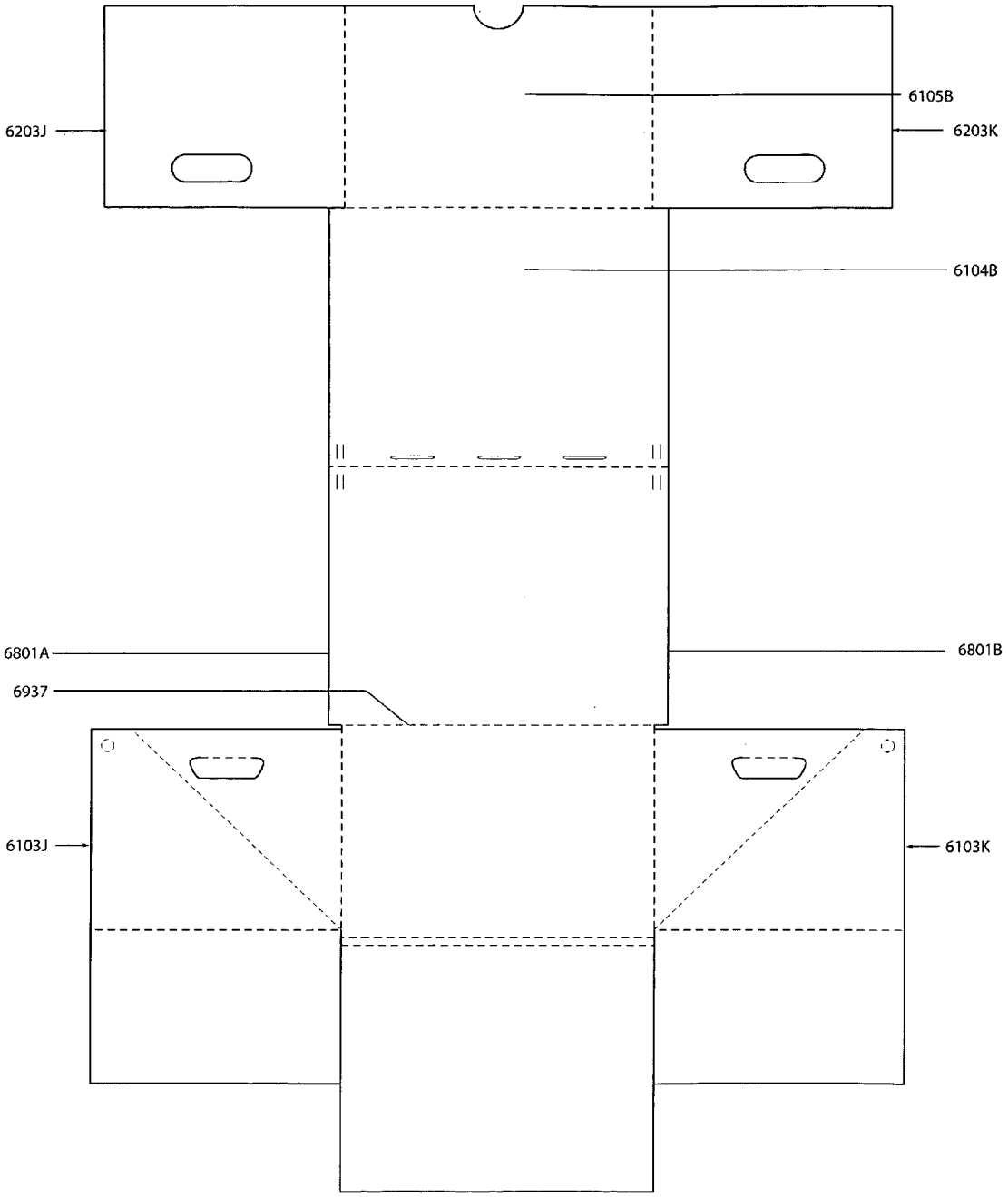
Figure 16C:
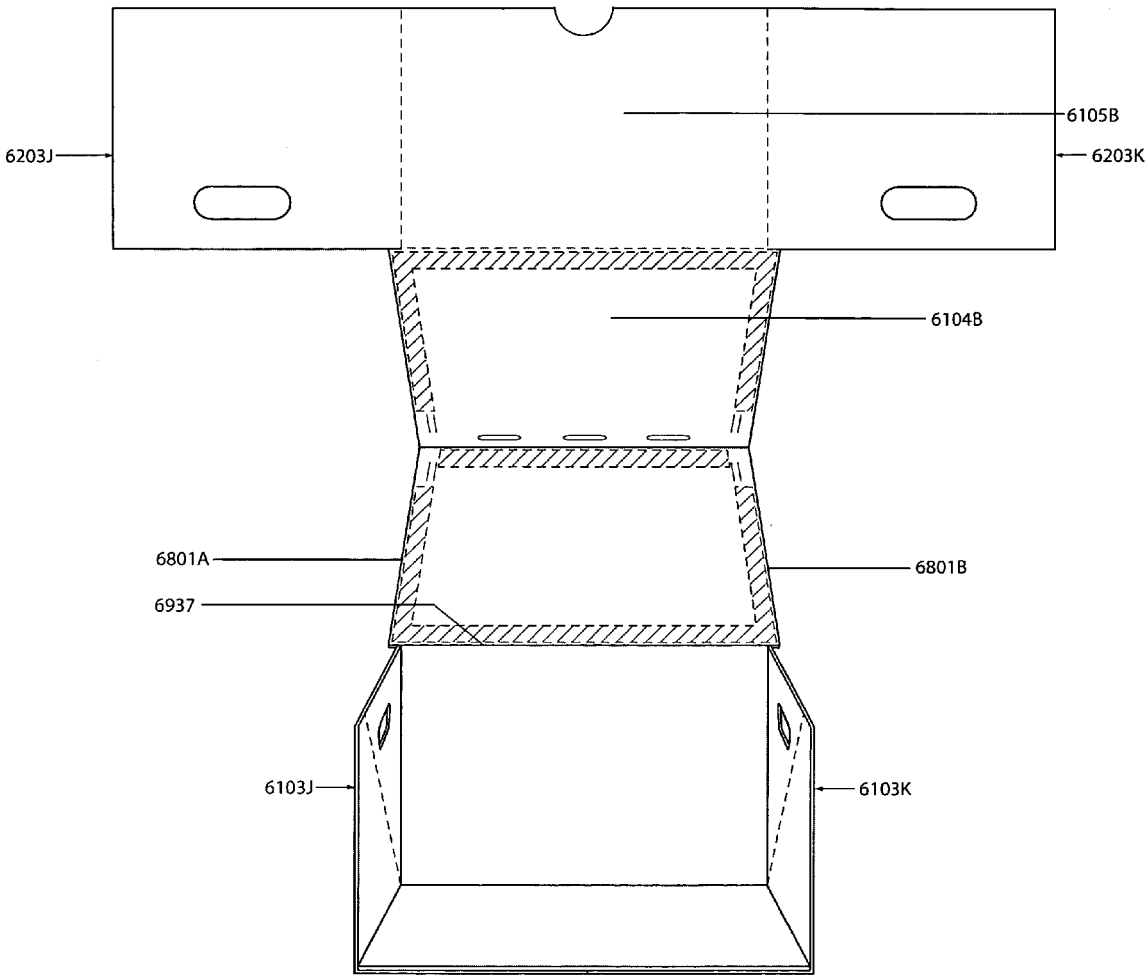
Figure 16D:
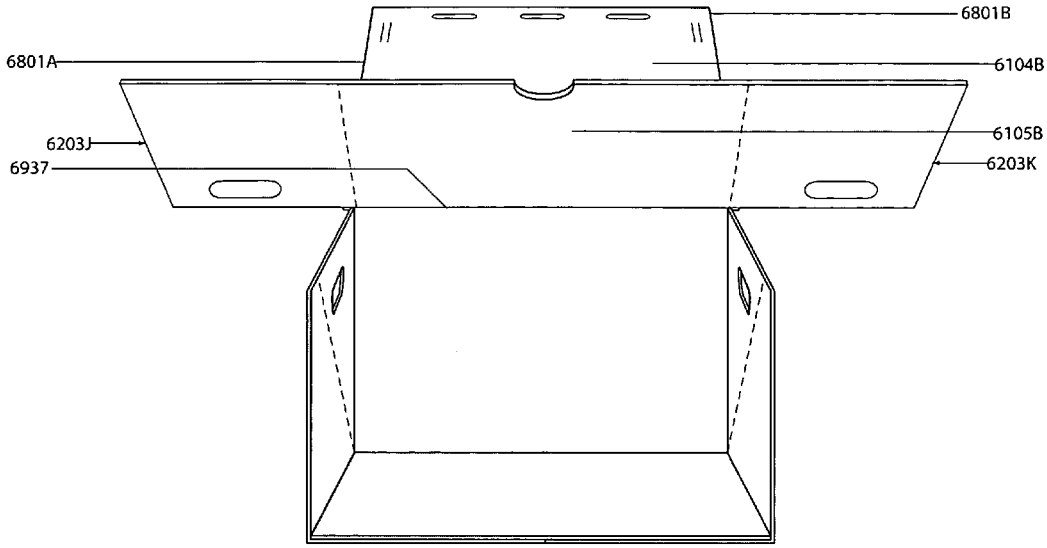
Figure 16E:
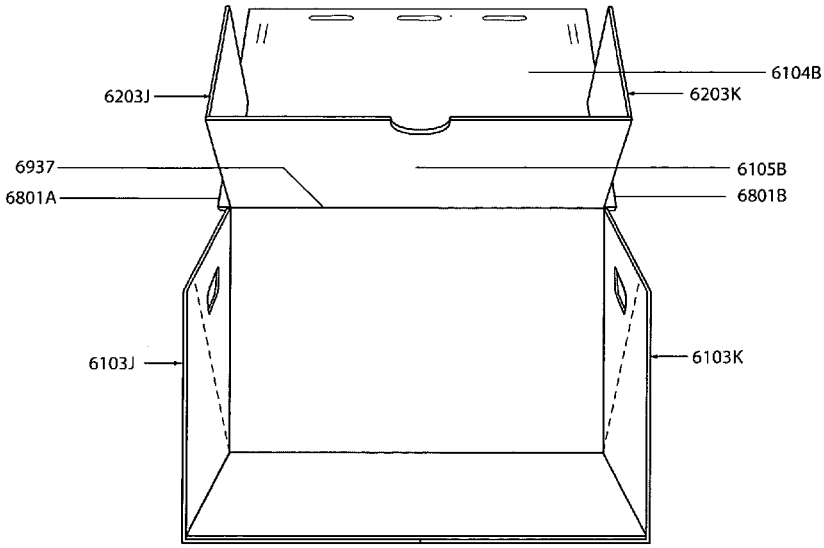

FIG. 16A shows the flat, die cut main sheet of corrugated from which such first alternative embodiment is primarily formed. FIG. 16B shows said flat die cut sheet after certain panels have been detached from it. FIGS. 16C through 16F are perspective views showing the successive steps in which the main body of the box of said first alternative embodiment is formed from flat sheet stock.

Figure 16F:
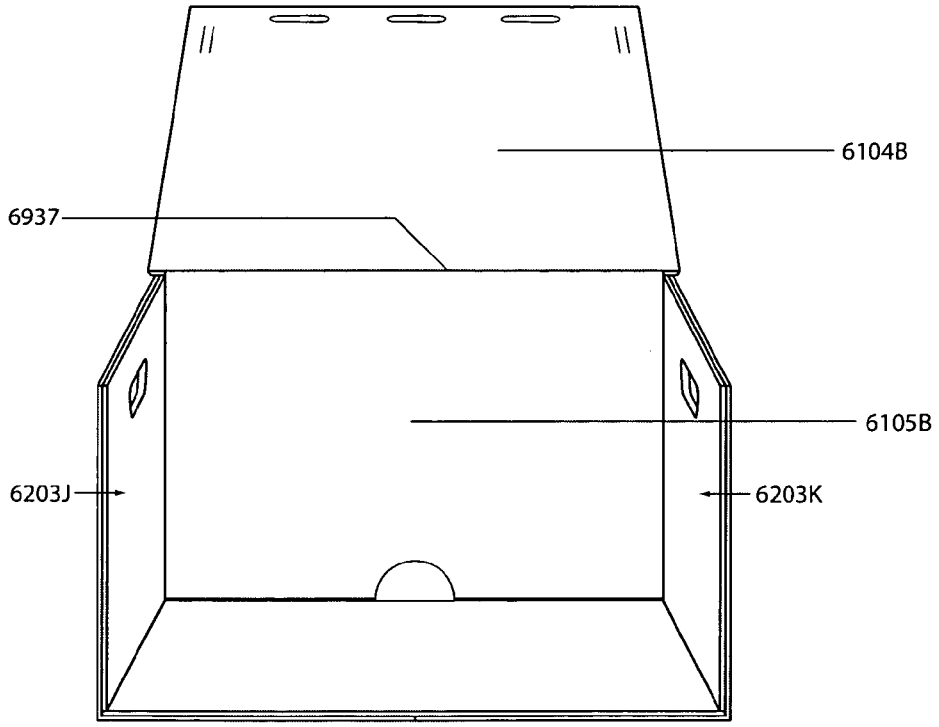

FIG. 16F shows panel 6105B after it has been turned downward along score line 6937 (FIG. 16B) to form the interior back wall of the box of said first alternative embodiment. Panels 6203J and 6203K, have been rotated downward along with panel 6105B, said panels 6203J and 6203K, thereby in position to comprise the opposed interior sidewalls of said box. In additional alternative embodiments, opposed interior sidewalls could be attached to the main body of said box in locations other than the interior back wall. For example, without limitation, said interior sidewalls could be attached along: (i) the bottom of the exterior sidewalls, (ii) the top of said exterior sidewalls or (iii) the front of said exterior sidewalls or (iv) the back of said exterior sidewalls or (v) along the left and right sides of the main floor of said box or (vi) along the left and right sides of the interior floor panel of said box.

In the above described preferred embodiment of the box of the present invention, the front door extends from the floor of said box. In, yet, another feature of the above stated first alternative embodiment, said front door is stored inside a hollow storage compartment that lies underneath the main body of said box.

FIG. 16A, in part, comprises flat panels 6621A and 6621B from which said hollow front door storage compartment (shown in FIGS. 17D thru 17F) is formed. FIG. 16B comprises the flat die cut sheet of FIG. 16A after panels 6621A and 6621B have been detached along cut lines 6801A and 6801B (FIG. 16A), respectively.

Figure 17A:
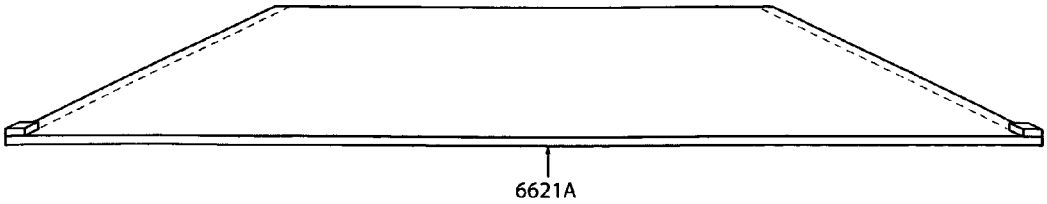
Figure 17B:
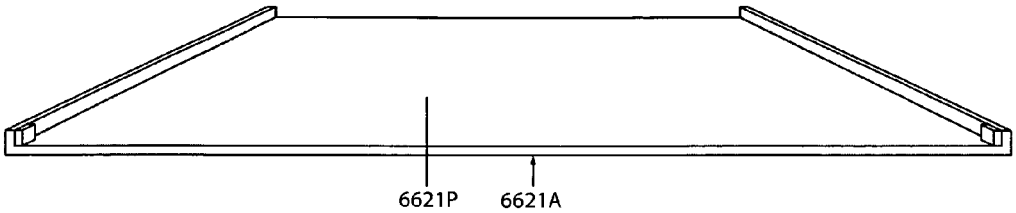
Figure 17C:
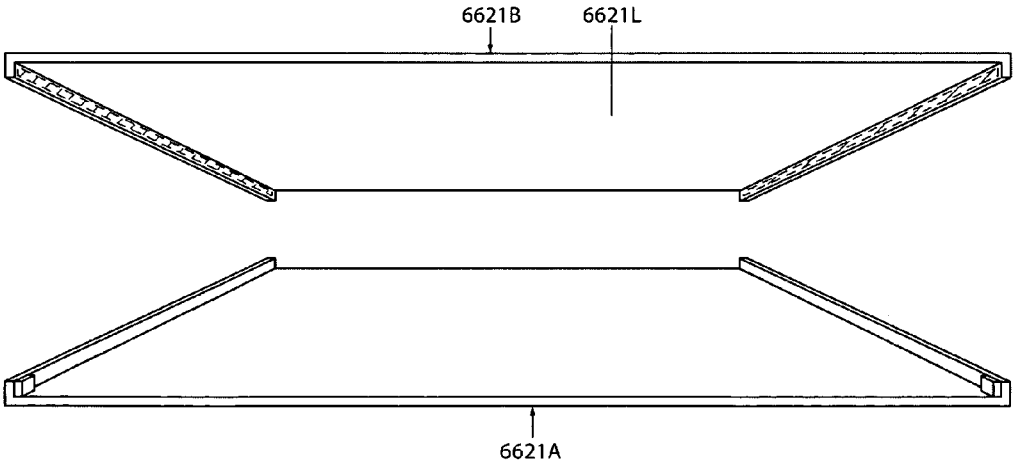
Figure 17D:
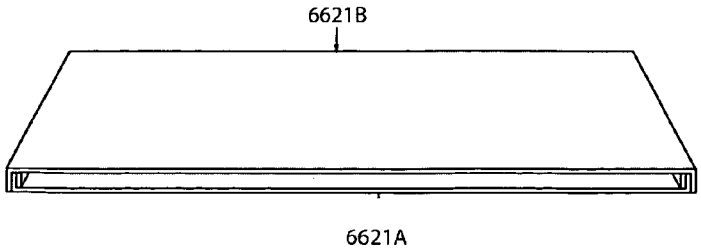
Figure 17E:
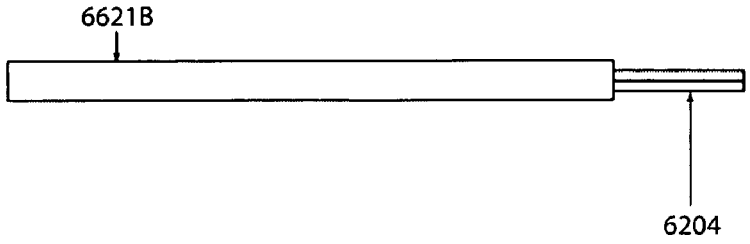
Figure 17F:
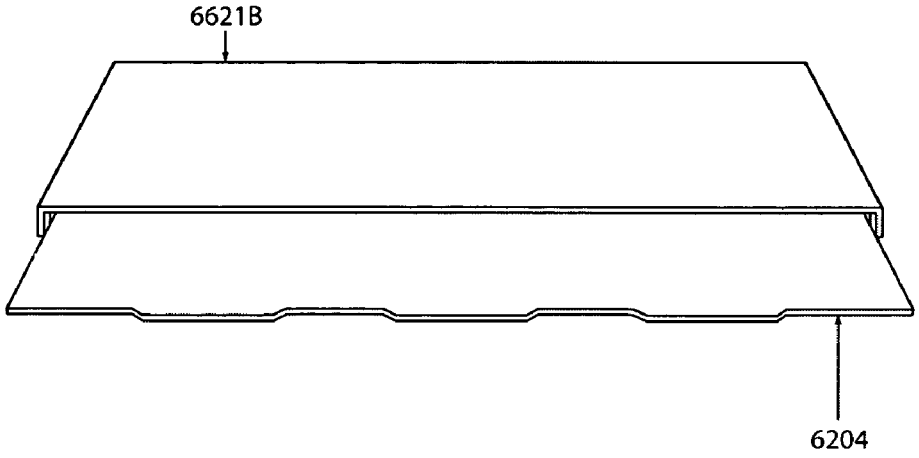

FIGS. 17A thru 17C are perspective views showing the components of the structure that comprises said hollow storage compartment. FIGS. 17D thru 17F show said components after they have been formed into a hollow compartment. Front door panel 6204 would typically be die cut from a separate sheet that is not embodied within the main sheet shown in FIG. 16A, although, in other embodiments, said flat panel could be cut from said main sheet. FIG. 17D shows a front view in which said front door is fully housed inside said storage compartment. FIGS. 17E and 17F respectively show a side view and a front view of said front door storage compartment with said front door partially protruding from said compartment.

Figure 18A:
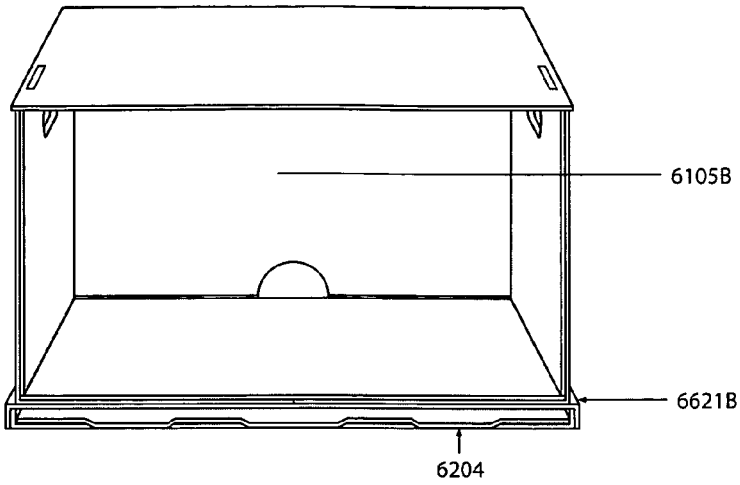
Figure 18B:
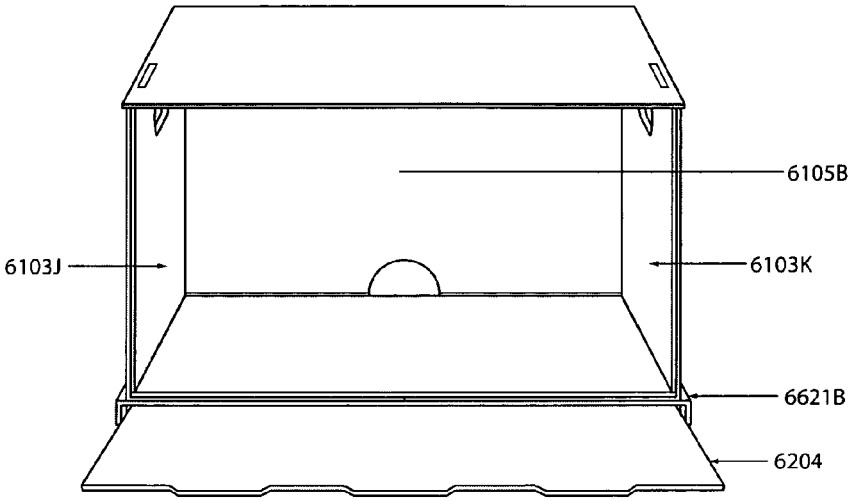
Figure 18C:
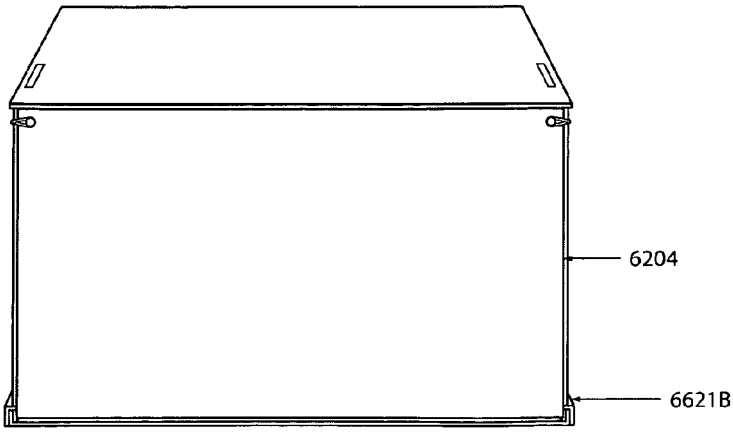

FIGS. 18A, 18B and 18C show front perspective views after said front door storage compartment has been glued to the bottom of said box. Said Figs., respectively show: (i) the front door panel fully housed inside said storage compartment, (ii) the front door panel protruding from said front door storage compartment and (iii) the panel after it has been pulled out of said compartment and rotated upward to form the front door of said box. In other alternative embodiments, the front door storage compartment could be attached either above or below the top lid, in front of or behind the back lid, or in other locations on said box.

Figure 18D:
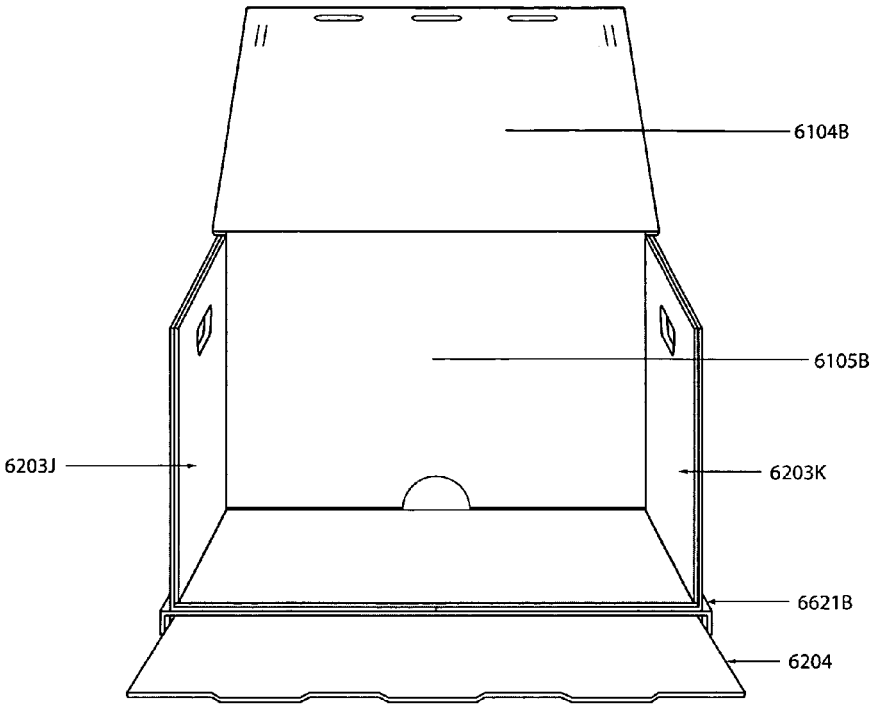
Figure 18E:
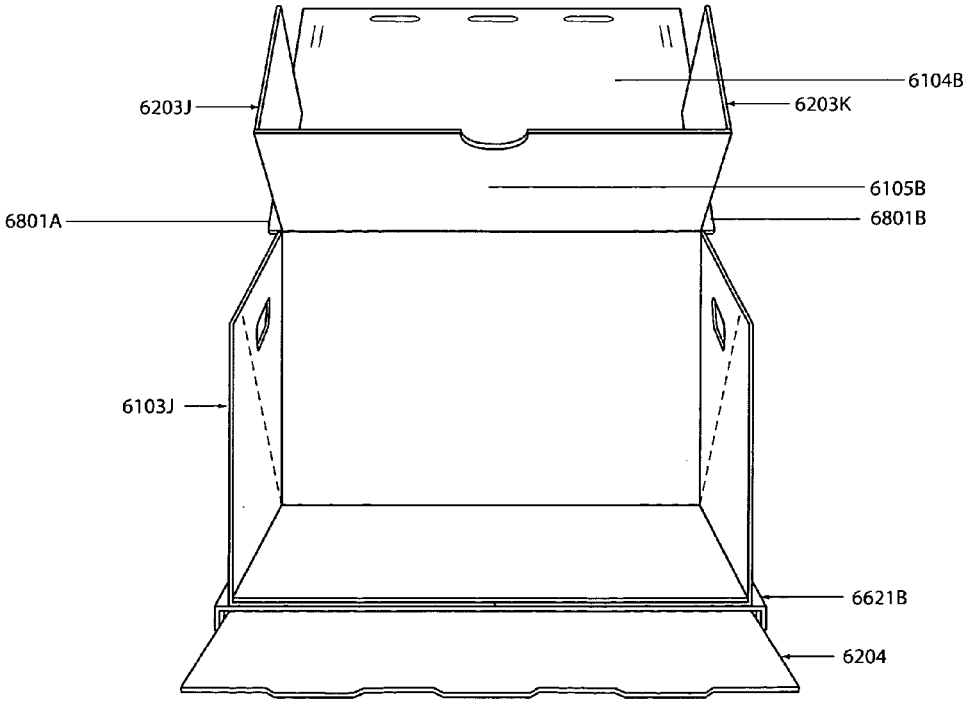
Figure 18F:
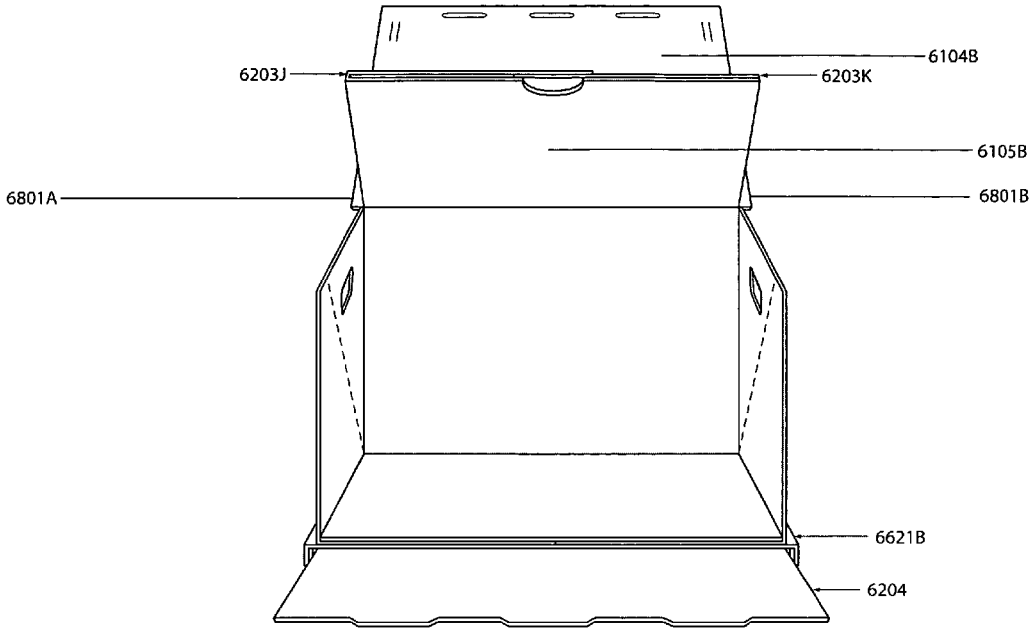
Figure 18G:
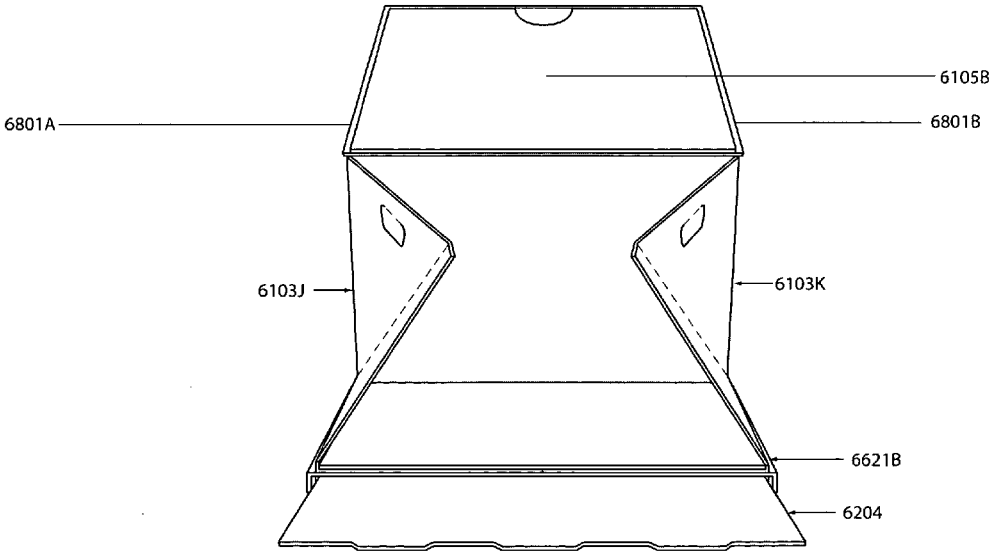
Figure 18H:
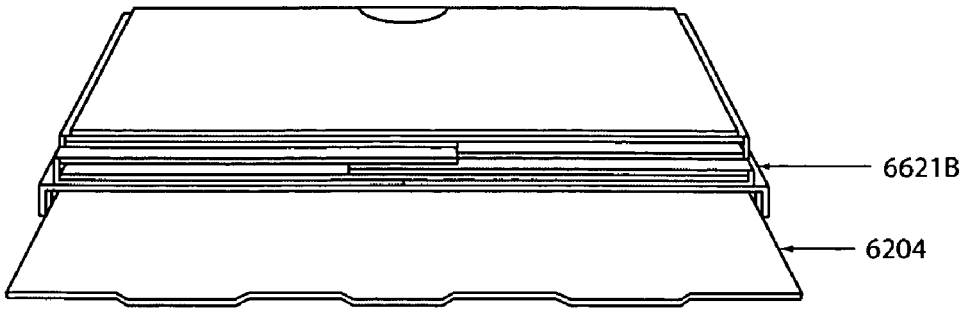
Figure 18I:
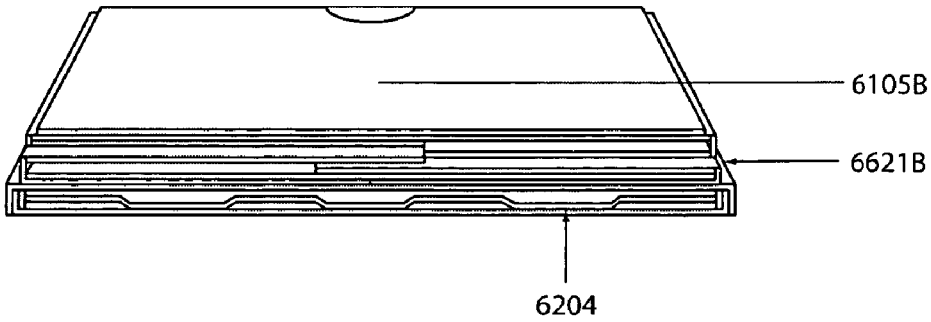

FIGS. 18D thru 18I show the box of said first alternative embodiment in successive stages of being collapsed. In FIG. 18D, top lid 6104B has been turned upward into open position. In FIG. 18E, interior sidewalls 6203J and 6203K and interior floor 6105B have been turned upward. In FIG. 18F, interior sidewall 6203J and 6203K have been turned 90 degrees inward. In FIG. 18G, exterior sidewalls 6103J and 6103K are in the process of being folded inward. In FIG. 18H, exterior sidewalls 6103J and 6103K have been folded fully downward. In FIG. 18I, front door panel 6204 has been pushed fully into the front door storage compartment, thereby completing the collapsing of said first alternative embodiment the box of the present invention.

Wherever the word "hinge" is used herein, such hinge comprises a means by which one or more of the surfaces to which said hinge is attached can pivot about an axis. Such hinge can be made of a variety of materials including, without limitation, metal, plastic or paper and can comprise a variety of different structures. In particular, such hinge may comprise a length of flat, flexible tape that is affixed to a surface by glue or other means. In the alternative, such hinge may created within a wall by simple scoring, creasing, or cutting partially through, said wall; such embodiment sometimes referred to as a "living hinge." The above applies to any variation of the word "hinge", such as "hinged" or "hingedly".

Wherever the word "glue" is used herein, other means of attachment may be used including, without limitation, staples, clips, rubber bands, string, cord, rope, pins, adhesive, adhesive backed tape and clamps. Similarly, in some instances the box may be formed without using any external means of attachment by simply relying on the various folds or other structures of the box to hold its elements in place.

While the above description contains many specificities, these should not be construed as limitations on the scope of the invention, but rather as exemplifications of one or more embodiments thereof. Other variations and embodiments are possible. Without limitation, such other embodiments may include variations in the flat sheet from which the box of the present invention may be formed. Those who are skilled in the art will readily perceive how to modify the invention. Therefore, the appended claims are to be construed to cover all equivalent structures which fall within the true scope and spirit of the invention and should not be limited to the embodiments illustrated.

We claim:

1. A collapsible box that, when in an open position, comprises:

a top lid, a floor, a back wall, a front door extending from said top lid, and a pair of opposed vertical sidewalls;

said sidewalls comprising an axis running along a bias about which said sidewalls can pivot and thereby collapse;

said bias on each sidewall extending upwardly and outwardly from a point at which a bottom of each sidewall meets the back wall of said box to a point at a top of each sidewall near a front of said box;

said top lid and said front door each adapted to pivot between open and closed positions; and said front door adapted to pivot to the open position when said top lid is in the closed position, thereby allowing top access to an interior of said box when said top lid is in the open position and allowing front access to the interior of said box when said front door is in the open position.

2. The box of claim 1, wherein said box is cut and formed from a flat sheet of material.

3. The box of claim 1, wherein said box is made from molded parts.

4. The box of claim 1, wherein said front door is stored inside a compartment attached to a location on said box, said location selected from a group consisting of an area that lies underneath main body of said box, the floor of said box, above the top lid of said box, below the top lid of said box, in front of the back wall of said box, and behind the back wall of said box.

5. The box of claim 1, wherein said sidewalls are attached to at least one location on said box, said location selected from a group consisting of an interior back wall of said box, bottoms of said sidewall, tops of said sidewalls, fronts of said sidewalls, backs of said sidewalls, along left and right sides of said floor of said box, and along left and right sides of an interior floor panel of said box.

6. The box of claim 1, wherein said box is made from a material selected from a group consisting of corrugated cardboard, paperboard, plastic, metal, and wood.

7. The box of claim 1, wherein said box is collapsible and adapted to be maintained in either open or closed positions without need to return it to flat sheet stock.

8. The box of claim 1, wherein said box is foldable and collapsible, adapted to be formed from flat sheet stock, and adapted to be maintained in either open or closed positions without need to return it to flat sheet stock.

9. The box of claim 1, wherein the front door extends from a location on the floor selected from a group consisting of an exterior floor panel, and interior floor panel, and a middle floor panel.

10. A collapsible box that, when in an open position, comprises:

a top lid, a floor, a back wall, a front door extending from said top lid, a pair of opposed vertical interior sidewalls, and a pair of opposed vertical exterior sidewalls, said exterior sidewalls comprising an axis running along a bias about which said exterior sidewalls can pivot and thereby collapse;

said bias on each sidewall extending upwardly and outwardly from a point at which a bottom of each exterior sidewall meets the back wall of said box to a point at a top of each exterior sidewall near a front of said box;

said top lid and said front door each adapted to pivot between open and closed positions; and said front door adapted to pivot to the open position when said top lid is in the closed position, thereby allowing top access to an interior of said box when said top lid is in the open position and allowing front access to the interior of said box when said front door is in the open position.

11. The box of claim 10, wherein said interior sidewalls comprise an axis about which said interior sidewalls can pivot thereby allowing said interior sidewalls to fold inward when said box is in the closed position and stand straight when said box is in the open position.

12. The box of claim 10, wherein said interior sidewalls extend from the floor of said box.

13. The box of claim 10, wherein said interior sidewalls are attached to at least one location on said box, said location selected from a group consisting of an interior back wall of said box, bottoms of said exterior sidewall, tops of said exterior sidewalls, fronts of said exterior sidewalls, backs of said exterior sidewalls, along left and right sides of said floor of said box, and along left and right sides of the interior floor panel of said box.

14. The box of claim 10, wherein the front door extends from the location on the floor selected from a group consisting of an exterior floor panel, an interior floor panel, and a middle floor panel.

15. A collapsible box that, when in an open position, comprises:

a top lid, a floor, a back wall, a front door extending from said top lid, and a pair of opposed vertical sidewalls;

said sidewalls comprising an axis running along a bias about which said sidewalls can pivot and thereby collapse;

said bias on each sidewall extending upwardly and outwardly from a point at which a bottom of each sidewall meets the back wall of said box to a point at a top of each sidewall near a front of said box; and said front door adapted to pivot between open and closed positions when said top lid is in either open or closed positions, thereby allowing front access to an interior of said box when said front door is in the open position.

16. The collapsible box according to claim 15, said opposed vertical sidewalls further comprising:

a pair of opposed vertical interior sidewalls; and a pair of opposed vertical exterior sidewalls including said axis running along said bias about which said exterior sidewalls can pivot and thereby collapse.

* * * * *